US008368559B2

(12) United States Patent
Pixley et al.

(10) Patent No.: US 8,368,559 B2
(45) Date of Patent: Feb. 5, 2013

(54) NETWORK OF TRAFFIC BEHAVIOR-MONITORING UNATTENDED GROUND SENSORS (NETBUGS)

(75) Inventors: Michael D. Pixley, Marana, AZ (US); Martt Harding, Annandale, VA (US)

(73) Assignee: Raytheon Company, Waltham, MA (US)

( * ) Notice: Subject to any disclaimer, the term of this patent is extended or adjusted under 35 U.S.C. 154(b) by 698 days.

(21) Appl. No.: 12/547,532

(22) Filed: Aug. 26, 2009

(65) Prior Publication Data

US 2011/0050461 A1 Mar. 3, 2011

(51) Int. Cl.
*G08G 1/01* (2006.01)
*G08G 1/056* (2006.01)
*G08G 1/042* (2006.01)

(52) U.S. Cl. ..... 340/933; 340/934; 340/935; 340/937; 340/506; 340/527; 340/539.23; 340/541; 340/551; 340/552; 340/8.1; 348/143; 348/149; 348/152

(58) Field of Classification Search ..... 340/933, 340/934, 935, 937, 506, 521, 541, 545.1, 340/551, 552, 8.1, 539.22, 539.23, 539.25; 348/143, 149, 152–154
See application file for complete search history.

(56) References Cited

U.S. PATENT DOCUMENTS

| | | | | |
|---|---|---|---|---|
| 4,815,757 | A | 3/1989 | Hamilton | |
| 5,650,928 | A * | 7/1997 | Hagenbuch | 701/1 |
| 6,056,237 | A * | 5/2000 | Woodland | 244/3.15 |
| 6,121,898 | A | 9/2000 | Moetteli | |
| 6,208,247 | B1 | 3/2001 | Agre et al. | |
| 6,587,779 | B1 | 7/2003 | Kerner | |
| 6,985,090 | B2 | 1/2006 | Ebner | |
| 7,336,203 | B2 | 2/2008 | Arquette | |
| 7,375,652 | B2 | 5/2008 | Reeves | |
| 7,382,281 | B2 | 6/2008 | Kavaler | |
| 7,480,560 | B2 | 1/2009 | Boll | |
| 7,633,391 | B2 * | 12/2009 | Voglewede et al. | 340/541 |
| 7,760,109 | B2 * | 7/2010 | Broad et al. | 340/539.23 |
| 8,022,987 | B2 * | 9/2011 | Ko et al. | 348/143 |
| 2002/0000920 | A1 | 1/2002 | Kavner | |
| 2004/0140909 | A1 * | 7/2004 | Meadows et al. | 340/905 |
| 2005/0041355 | A1 * | 2/2005 | Page | 361/117 |
| 2005/0209769 | A1 | 9/2005 | Yamashita | |

(Continued)

FOREIGN PATENT DOCUMENTS

DE 4228539 A1 3/1994

OTHER PUBLICATIONS

Eng-Han, Ng et al., "Road traffic monitoring using a wireless vehicle sensor network," 2008 International Symposium on Intelligent Signal Processing and Communications Systems (ISPACS 2008), Bangkok, Thailand, Feb. 8, 2009, pp. 1-7.

Hock, Ben Lim et al., "An adaptive distributed resource allocation scheme for sensor networks," Mobile Ad-Hoc and Sensor Networks, Second International Conference, MSN 2006, Hong Kong, China, Dec. 13, 2006, pp. 770-781.

*Primary Examiner* — George Bugg
*Assistant Examiner* — Anne Lai
(74) *Attorney, Agent, or Firm* — Eric A. Gifford

(57) ABSTRACT

A Network of Traffic Behavior-monitoring Unattended Ground Sensors (NeTBUGS) is configurable to detect the passing of vehicles, determine when and where individual vehicles have stopped for a period of time that raises suspicion of illegal or dangerous activity, track the vehicles after the stop and to generate a location-tagged alert for the timely dispatch of a response asset to investigate the anomalous behavior of the vehicle. NeTBUGS sensors are small, camouflaged, easily concealed, and operate for long durations independent of the electrical grid or large, obvious power generators and thus well suited for operation in a hostile environment.

37 Claims, 16 Drawing Sheets

U.S. PATENT DOCUMENTS

2007/0080799 A1* 4/2007 Werenka ..... 340/506
2007/0080863 A1 4/2007 Glockler et al.
2007/0222595 A1* 9/2007 Motteram et al. ..... 340/572.1
2007/0236343 A1* 10/2007 Becksted et al. ..... 340/521
2009/0201143 A1* 8/2009 McKenna et al. ..... 340/506

* cited by examiner

MODES

- BUILT-IN TEST (BIT), HEALTH, STATUS MODES
  - TEST AND REPORT NODE HEALTH AND READINESS
- NODE AND NETWORK EMPLACEMENT MODES
  - TEST MESSAGE TRAFFIC WITH OTHER NODES AND CONTROL STATION
  - TRANSMIT SENSOR NODE LOCATION TO CONTROL STATION (IF NODE EQUIPPED WITH GPS)
  - ASSIGN NODE LOCATION (IF DERIVED FROM EMPLACEMENT PROCESS)
  - ASSIGN NODE NUMBERING AND RELATE TO NODE LOCATIONS
  - CONSTRUCT MAP OF SENSOR NETWORK WITH SENSOR LOCATIONS
- CALIBRATION MODES
  - CALIBRATE NODES TO DETECT PASSING VEHICLES
  - CALIBRATE TRANSMIT POWER LEVELS
  - CALIBRATE TRAFFIC FLOW FOR POWER MANAGEMENT
  - CALIBRATE NODES AND NETWORK TO LOCAL TRAFFIC CONDITIONS
  - CALIBRATE NODES FOR DIRECTION OF VEHICLE TRAFFIC
- OPERATIONAL MODES
  - POWER MANAGEMENT (ENABLE OPERATIONS/STANDBY MODES)
  - VEHICLE DETECTION MODE
    - VEHICLE PRESENCE DETECTION (DETECTION MESSAGE: MSG ID, NODE ID, TIME, DIRECTION)
    - ALERT OPTION (ALERT PRESENCE MESSAGE)
    - TRAFFIC DENSITY DETECTION
  - VEHICLE DELAY MODE
    - VEHICLE DELAY DETECTION (ALERT DELAY MESSAGE: MSG ID, NODE ID, TIME, DIRECTION)
    - VELOCITY-SENSITIVE DELAY-TIME INCREMENT
    - ENHANCED DELAY (REPEAT DELAY ALERT)
  - VEHICLE TRACK MODE
    - IF DELAY ALERT SENT, ENTER DETECTION MODE
    - LOCAL OR UNIVERSAL TRACK MODE
  - DATA TRANSFER MODE
    - REPORT DETECTION HISTORY SINCE LAST DOWNLOAD (DETECTIONS, STATISTICS, ETC.)
    - RECEIVE DATA FROM CONTROL STATION
  - ANTI-TAMPER MODE
    - IF NODE MOVES, BROADCAST PERIODIC ALERT (MSG ID, NODE ID, TIME STAMP, LOCATION (IF GPS EQUIPPED))

FIG.10

REMOTE COMMAND & CONTROL OF NODES

- BIT, HEALTH, STATUS
- NODE AND NETWORK EMPLACEMENT
- CALIBRATION
- OPERATIONAL
  - POWER MANAGEMENT MODE
    - SEND OPERATIONS/STANDBY TIMES TO SENSOR NODES
  - VEHICLE DETECTION MODE
    - ENABLE/DISABLE ALERT
    - ENABLE/DISABLE AND SET DENSITY
  - VEHICLE DELAY MODE
    - SET EXPECTED TIME INCREMENT (GATHER LOCAL STATISTICS, EXTERNAL INFORMATION)
    - SET DELAY TIME INCREMENT (THRESHOLD VEHICLE STOP TIME, NUISANCE ALARM RATE, MULTIPLIER, X-SIGMA)
    - ENABLE SENSOR NODE TO DETERMINE EXPECTED AND/OR DELAY TIME INCREMENTS
    - ENABLE LOCAL COMPENSATION OF EXPECTED TIME INCREMENT ON REPORTED TARGET VEHICLE SPEED
    - ENABLE/DISABLE ENHANCED RELAY MODE
  - VEHICLE TRACK MODE
    - ENABLE/DISABLE TRACK MODE
    - ENABLE LOCAL OR UNIVERSAL
  - DATA TRANSFER MODE
    - ENABLE/DISABLE DATA TRANSFER TO ADJACENT SENSOR NODES
    - ENABLE/DISABLE DATA TRANSFER TO CONTROL STATION

FIG.11

NETWORK OF TRAFFIC BEHAVIOR-MONITORING UNATTENDED GROUND SENSORS (NETBUGS)

BACKGROUND OF THE INVENTION

1. Field of the Invention

This invention relates to situational awareness of vehicle traffic behavior and more particularly to a sensor network for detecting anomalous behavior of individual vehicles during off-peak, low-density conditions and tracking the target vehicle until another asset can be tasked to investigate.

2. Description of the Related Art

Traffic behavior monitoring technology has expanded significantly in the last few decades. Existing traffic monitoring systems provide local and regional traffic officials with a variety of capabilities for monitoring traffic flow patterns for the purposes of improving traffic control systems, traffic laws, and law enforcement. Traffic monitoring systems used by local and regional traffic control officials fall into two primary classes: mass traffic flow monitoring systems and discrete vehicle behavior detection systems.

Mass traffic flow monitoring systems monitor large vehicle traffic patterns in certain discrete areas to report traffic jams or slow-downs, or to study macro-flow patterns in support of traffic control analysis. Technologies employed for these purposes include fixed cameras or radars tied into the city electrical power grid that communicate using wireless technology. A mobile technology used for studying macro-flow patterns is the pneumatic road tube system, which uses a pneumatic line that is hand-emplaced across a road and records the number of vehicles that run over the line. Data collected by mobile systems such as pneumatic line tubes require that the systems be relocated many times to different areas over a long period of time during the duration of the study.

Discrete vehicle behavior detection systems detect individual, discrete vehicles for the purpose of detecting traffic violations such as speeding or red-light running. Generally, these systems employ radars or cameras (or both), often hard-mounted to traffic signals at intersection and hardwired into the city power grid. These systems report detections of individual vehicle behavior at discrete points along a road or at a traffic intersection. All of the above systems require either manual emplacement or permanent installation. The radar and camera systems also require directional alignment of sensors.

Similar technologies are employed to conduct surveillance of human traffic at international borders, although the concepts of operations are quite different than for traffic monitoring. In addition to direct observation by border patrol agents, several technical means are employed to detect illegal border penetration activity. These systems include: a) observation towers equipped with infrared cameras, radars, or other sensors; b) airborne platforms, both manned and unmanned, equipped with detection sensors; c) ground or maritime patrol vehicles equipped with binoculars, cameras, or other detection aids; and d) unattended ground sensors. Each of these systems, including unattended ground sensors, is designed for direct detection of border crossers. Unattended ground sensor units are designed to detect illegal activity directly through detections made by individual sensor units acting in isolation from each other, although network activity may be used following detection for system communication and control purposes. In addition to directly detecting a border penetration attempt, border agents always remain vigilant to detect potential threat ground pick-up/drop-off and transportation activity in support of a border penetration. For this reason, maintaining situational awareness through persistent surveillance of traffic patterns in border areas is a crucial aspect of border security, especially in wide-area, rural, or remote border regions. Currently, the only means of detecting in-country threat transportation support are direct observation by border patrol agents, and manned traffic control points.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a Network of Traffic Behavior-monitoring Unattended Ground Sensors (NeTBUGS) that is configurable to detect the passing of vehicles and when individual vehicles have been delayed for a period of time that raises suspicion of illegal or dangerous activity to generate an alert for the timely dispatch of a response asset to investigate the anomalous behavior of the vehicle. NeTBUGS sensors are small, camouflaged, easily concealed, and operate for long durations independent of the electrical grid or large, obvious power generators and thus well suited for operation in a hostile environment.

This is accomplished with a plurality of autonomously-powered sensor nodes in an ordered network in communication with a control station. Each sensor node has a programmable power management mode including standby and operations times corresponding to high and low-density anticipated traffic, respectively. During operations, each sensor node detects the time and direction of travel of a passing vehicle and transmits via a communication link a detection message including a node identifier, the detection time and the direction of travel to adjacent nodes and receives detection messages from adjacent nodes. Each sensor node operates in a delay mode in which upon passing of a specified time increment from the detection time reported by the adjacent node without detecting the passage of the anticipated vehicle the node broadcasts an alert delay message including a node identifier, an alert time of vehicle non-arrival and the direction of travel via the communication link. The control station includes a computer configured to receive alert delay messages and, knowing the topology of the ordered network and the geolocation of each sensor node and thereby the constrained location of the anomalous vehicle activity, to facilitate timely dispatch of an asset to investigate the anomalous activity.

These and other features and advantages of the invention will be apparent to those skilled in the art from the following detailed description of preferred embodiments, taken together with the accompanying drawings, in which:

BRIEF DESCRIPTION OF THE DRAWINGS

FIG. 10 is a table of modes;

FIG. 11 is a table of remote command and control of nodes;

DETAILED DESCRIPTION OF THE INVENTION

Figure 1:
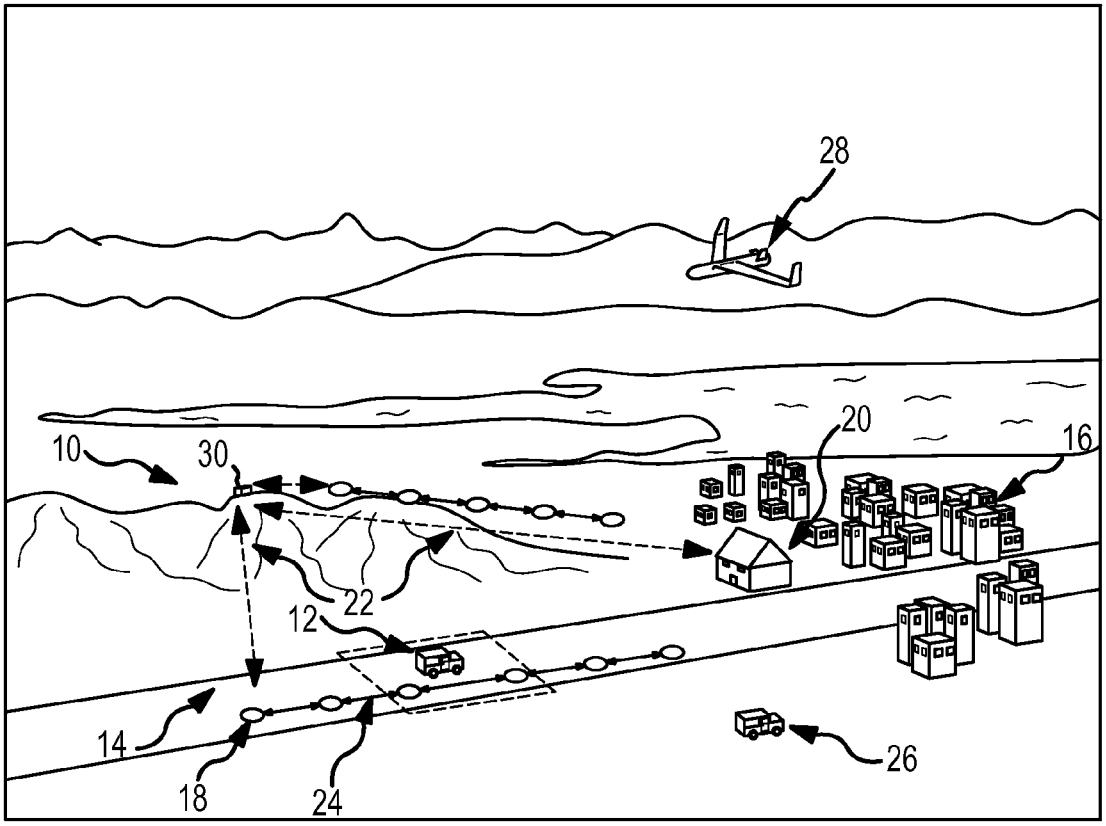
FIG. 1 is a diagram of an operational NeTBUGS system to detect anomalous traffic behavior during low-density traffic conditions.
Figure 2:
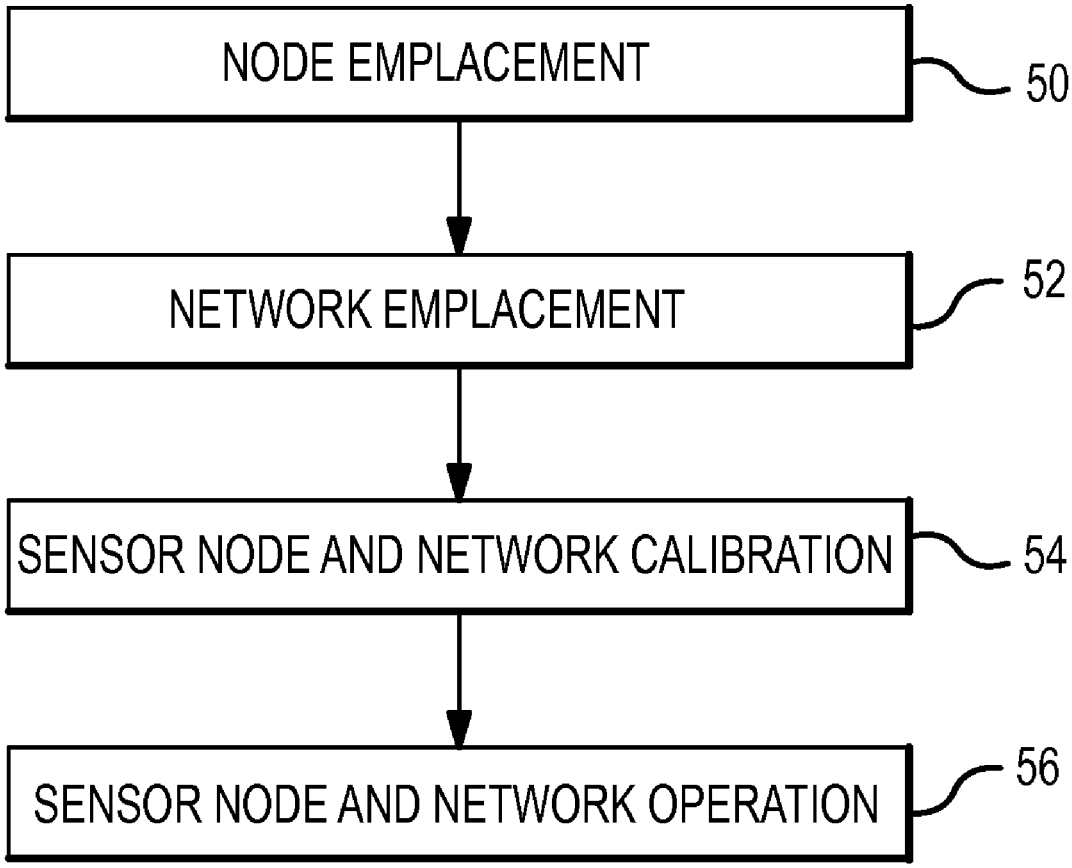
FIG. 2 is a flow diagram for emplacement, calibration and operation of NeTBUGs.

Traffic behavior monitoring systems and technologies operate quite well for measuring normal, peaceful activity such as macro traffic flow or infractions of traffic laws by individual vehicles in a lawful, permissive environment. However they are not suitable for detecting illegal or threatening activity of individual vehicles while operating in a hostile or semi-hostile environment characterized by attentive, adaptive, and responsive threat organizations. Existing traffic monitoring systems generally utilize existing power infrastructure such as the electrical power grid, for permanent or long duration systems, and mobile power generators or large batteries for relatively short duration systems. These systems require intensive manual emplacement and alignment of the sensors (cameras and radar). These systems are extremely vulnerable and are also extremely obvious as to their existence and purpose for traffic monitoring. They are not amenable to effective camouflage or concealment techniques except to the minor extent possible for aesthetic reasons. Such systems cannot operate autonomously in remote areas for long durations of weeks or months at a time in a camouflaged and easily concealed configuration. Existing traffic monitoring systems are not generally designed to measure traffic flows over very large areas simultaneously in a non-permissive, hostile environment. Mobile and movable traffic monitoring systems are regularly repositioned over a period of days or weeks to slowly build a wide-area model of traffic behavior. Existing systems designed for measuring regular macro-traffic behavior patterns cannot provide the simultaneous, wide-area detection coverage necessary for a persistent threat detection capability. Existing systems designed to monitor traffic infractions of individual vehicles require careful manual emplacement and only measure discrete points in the wide-area. Further, existing systems are not survivable in a hostile environment where threat organizations attempt to locate, avoid, defeat and, if possible, destroy the system as well as any supporting infrastructure. In such a hostile environment, the sensors in such a system must be small, camouflaged or easily concealed, easily emplaced, and operate for long durations independent of the electrical grid or large, obvious power generators.

One primary mission area where there is a noticeable gap in threat traffic detection capability in a potentially hostile environment is in the area of border security. All sovereign states recognize the necessity to secure their borders against illegal immigration, smuggling activity, and uncontrolled cross-border movement, although states vary in the extent to which they achieve these objectives. In many areas of the world, such activity occurs along large stretches of land or coastal border in sparsely populated areas that are difficult to monitor or patrol adequately. Illegal border penetrations may involve movement by any of several means such as movement on foot, by ground vehicle, or by boat. Once inside the country, however, border violators in remote areas often have a large distance to travel to their in-country destination whether it be a criminal safe-house, a relative's house, or some other destination. For border penetrations made on foot or by boat, it is extremely common for the violators to meet pre-arranged ground transportation at a designated pick-up point to move them to their first in-country destination. For border penetrations made by ground vehicle, the violators may either drive to their destination or, in the case of all terrain vehicles (ATV's) or motorcycles, perhaps meet a pre-arranged transport truck.

NeTBUGS

The present invention provides a Network of Traffic Behavior-monitoring Unattended Ground Sensors (NeTBUGS) that is configurable to detect the passing of vehicles, determine from anomalous transit times between sensors when individual vehicles have stopped and thereby raise suspicion of illegal or dangerous activity, track the vehicles after the stop and to generate an alert for the timely dispatch of a response asset to investigate the anomalous behavior of the vehicle and the area where the stop occurred. NeTBUGS sensors are small, camouflaged, easily concealed, and operate for long durations independent of the electrical grid or large, obvious power generators and thus well suited for operation in a hostile environment.

As illustrated in FIG. 1, an embodiment of a NeTBUGS system 10 is deployed to monitor traffic behavior of individual vehicles 12 on rural roads 14 outside a town 16. NeTBUGS system 10 includes a plurality of autonomously-powered sensor nodes 18 in an ordered network in communication with a control station 20, typically located within a tactical operations center (TOC). Each sensor node has a programmable power management mode including standby and operations times corresponding to high and low-density traffic behavior, respectively. These times may be programmed remotely from the control system to configure or reconfigure the system to anticipated local traffic behavior. A unique aspect of NeTBUGS is that the network and individual nodes are configured to detect anomalous behavior during off-peak or low-density traffic conditions. Because NeTBUGS is directed to detecting illegal or threatening vehicle behavior, not merely macro traffic flow or traffic infractions, it is reasonable to assume that such behavior will occur in locations and at times of low-density traffic e.g. on rural roads in the middle of the night. Typically, NeTBUGS will be deployed where traffic density during operations is <600 vehicles/hour or 10 vehicles per minute and more typically <180 vehicles/hour or 3 per minute.

During operations, each sensor node detects the time and direction of travel of a passing vehicle 12 and transmits via a communication link a detection message including a node identifier, the detection lime and the direction of travel to adjacent nodes and receives detection messages from adjacent nodes. Each sensor node operates in a delay mode in which upon expiration of a specified time increment from the detection time reported by the adjacent node without detecting the passage of the anticipated vehicle the node broadcasts an alert delay message including a node identifier, an alert time of vehicle non-arrival and the direction of travel via the communication link. The alert delay message may be retransmitted by other network nodes and is subsequently received at the control station. The specified time increment may represent an expected time increment to detect the passage of the anticipated vehicle plus a delay time increment that provides a threshold for issuing an alert. The delay time increment may be a fixed multiplier, certain number (potentially fractional) of standard deviations, a fixed time or correspond to a delay calibrated to a specified nuisance alarm rate. Both the expected and delay time increments may be calibrated at the local sensor nodes or provided by the control station. The sensor nodes may also be configured remotely from the control station to enable an alert detection mode which broadcasts the detection messages as alert messages that are received by both the adjacent sensor nodes and the control station and a track mode which if enabled enables the alert detection mode for at least the nodes in the vicinity of any node issuing a alert delay message.

The network may employ a single wireless communication link 22 for all communications between sensors nodes and between sensors nodes and the control station. Sensor nodes may be configured to vary their transmission power for local communication with adjacent nodes and for remote communication with the control station to conserve power. Or alert messages may be relayed from node-to-node until the messages reach the node closest the control station at which point they are transmitted to the control station. Alternately, the network may employ a low-power local wireless communications link 24 between sensor nodes and utilize a high-power communications link 22 to communication from designated relay nodes 30 to the control station. The relay nodes may be configured to only receive local message traffic (short-range RF communications) and relay the alert messages to the control station (long-range RF communications). The relay node may receive message traffic from the control station and distribute the messages to the sensor nodes. Alternately, the relay node may include some or all of the sense and processing capability of a sensor node. Individual sensor nodes may be able to communicate directly with the relay nodes or the alert messages may be relayed node-to-node until they reach the relay node.

The control station 20 suitably includes both short range RF communications and long-range RF communications plus a computer configured to receive alert delay messages and, knowing the topology of the ordered network and the geolocation of each sensor node, to facilitate timely dispatch of an asset to investigate the anomalous behavior of the vehicle e.g. the location where the vehicle stopped, or track the vehicle. The alert is suitably provided through a computer human interface to an operator, to provide a visual display of the monitored road network, the geolocation of each node with its status, any alert messages that have been received and the tracking of any target vehicles through the network. The operator in turn dispatches the asset or places a request to dispatch the asset. Alternately, the system could under certain circumstances be configured to determine the appropriate asset and dispatch that asset automatically. The assets may be manned response assets (MRA) such as a HMMWV 26 or unmanned response assets (URA) such as an unmanned aerial vehicle (UAV) 28. For an effective response to illegal or threatening behavior in a hostile environment a "timely" dispatch may be quite important. A sensor node in NeTBUGS can alert the control station in less than 1 minute and typically less than 10 seconds from the initial determination of a delayed vehicle by that sensor node. The control station may then dispatch the asset in typically 1-5 minutes. NeTBUGS can thus provide a near-real-time response to the detection of anomalous traffic behavior by individual vehicles.

NeTBUGS: Emplacement, Calibration & Operations

To deploy the NeTBUGS system, the individual nodes and network must be emplaced (steps 50 and 52), the nodes and network calibrated (step 54) and finally the nodes and network must be operational (step 56). Precisely what steps must be performed and in what order to emplace, calibrate and operate NeTBUGS may vary depending on specific node configurations, network configurations and the application to which NeTBUGS is applied.

In general, the emplacement of nodes in step 50 will includes pre-deployment steps such as charging the node (e.g. charging or installing batteries), verifying the Power On Self Test (POST), performing a built-in self test (BIT) and verifying health and internal operation of each node. As the nodes are being deployed along the side of a road, the BIT and health tests are performed again. Each node is tested to verify that it can detect a passing vehicle and determine its direction of travel, verify network communications transmit and receive functionality, verify communications connectivity with other sensors nodes and verify communications connectivity with relay nodes if part of the network. If each node incorporates a geolocation receiver (e.g. a GPS receiver), they are tested to verify operability and to transmit the position of each node. If a node failure is detected a second trailing deployment vehicle deploys a replacement. Essentially, node emplacement verifies that each node can perform its vehicle detection functions, communicate with adjacent nodes and communicate with the control station.

The emplacement of the network in step 52 includes such steps as installing the computer for the control station, installing RF equipment linking the control station to network of NeTBUGS sensor nodes, running a self test for the control station, verifying the connectivity between the control station and entity(ies) used to request surveillance by manned and unmanned response assets, verifying proper message content and reception between control station and entity(ies) used to request surveillance, verifying connectivity between control station and each node in the network, exercising a self-test in each node to determine the health and projected battery lifetime of each node, logging the geolocation of each node, assigning sequence node identifier numbers to nodes and propagating them throughout the ordered network, verifying communication between adjacent nodes in the ordered network, performing testing to determine which nodes can be missing while retaining a functional network and setting and propagating a network clock time and date.

The calibration of individual nodes and the network in step 54 may address calibration of the nodes to detect passing vehicles with a high likelihood of detection and a low false alarm rate, determining transmit power levels for local communication among adjacent nodes and for remote communication with the control station, determining the standby and operation times for power management mode, and the collection of traffic statistics to determine the specified time increments for delay reporting. To configure power management mode, the control station may command each node to collect statistics for a sample period on vehicles passing (time and direction of passing), request, receive and process the statistics from each node to determine traffic-flow parameters vs. location and time of day (and perhaps day of week, holiday, etc in addition), determine the likely periods of useful sensor effectiveness and propagate active/standby times to all nodes. Input from supported organizations may lead to revisions in the active/standby limes based on local intelligence of the traffic behavior they need to monitor. To determine the expected time increment for typical vehicle traffic, each sensor node collects traffic statistics (e.g. the time for a vehicle to pass from an adjacent node, in both directions). These statistics may be used locally at each node to determine the time increments or may be transmitted to the control station.

NeTBUGS has various operational modes that may be remotely enabled and exercised in step 56. NeTBUGS enables a local Detection Mode in which the nodes detect passing vehicles and communicate a detection message to the adjacent nodes and a Delay Mode in which nodes upon receipt of such a detection message wait a specified time increment for the anticipated vehicle passing and if the vehicle is not detected communicate an alert delay message to the control system. NeTBUGS may also enable more sophisticated versions of the Detection and Delay Modes, a Track Mode, an Anti-Tamper Mode and misc BIT, Health and Status modes. NeTBUGS may aggregate statistics on a specific vehicle as it travels through the network (e.g. average velocity) to adjust the expected lime increments. In an embodiment, these modes may be enabled/disabled and their parameters set remotely by communication of a control message from the control station to the individual nodes.

Sensor Nodes and Emplacement

Threat traffic detection capability in a potentially hostile environment places certain practical constraints on the deployment and emplacement of nodes. The hostile environment presents a threat to both the personnel charged with deploying and emplacing the sensors and to the sensor nodes with respect to their being found or tampered with. Consequently, it is preferred that the NeTBUGS nodes are autonomously-powered (e.g. batteries, solar power, etc.) and suitably camouflaged for the local environment (e.g. size, shape, color, texture, etc.). It is also preferred that the nodes can be deployed by "throwing" them, manually or via a sensor deployment device, from the back of a moving vehicle. To do this, the sensor node and the one or more sensors within the node are preferably configured to provide a certain degree of freedom to how the nodes land. A traditional node emplacement that involves manually connecting the node to an electrical power grid and carefully aligning the sensor (e.g. camera or radar) or running a pneumatic line across the road would expose both the personnel and the nodes to a threat and also limit deployment options.

Figure 3:
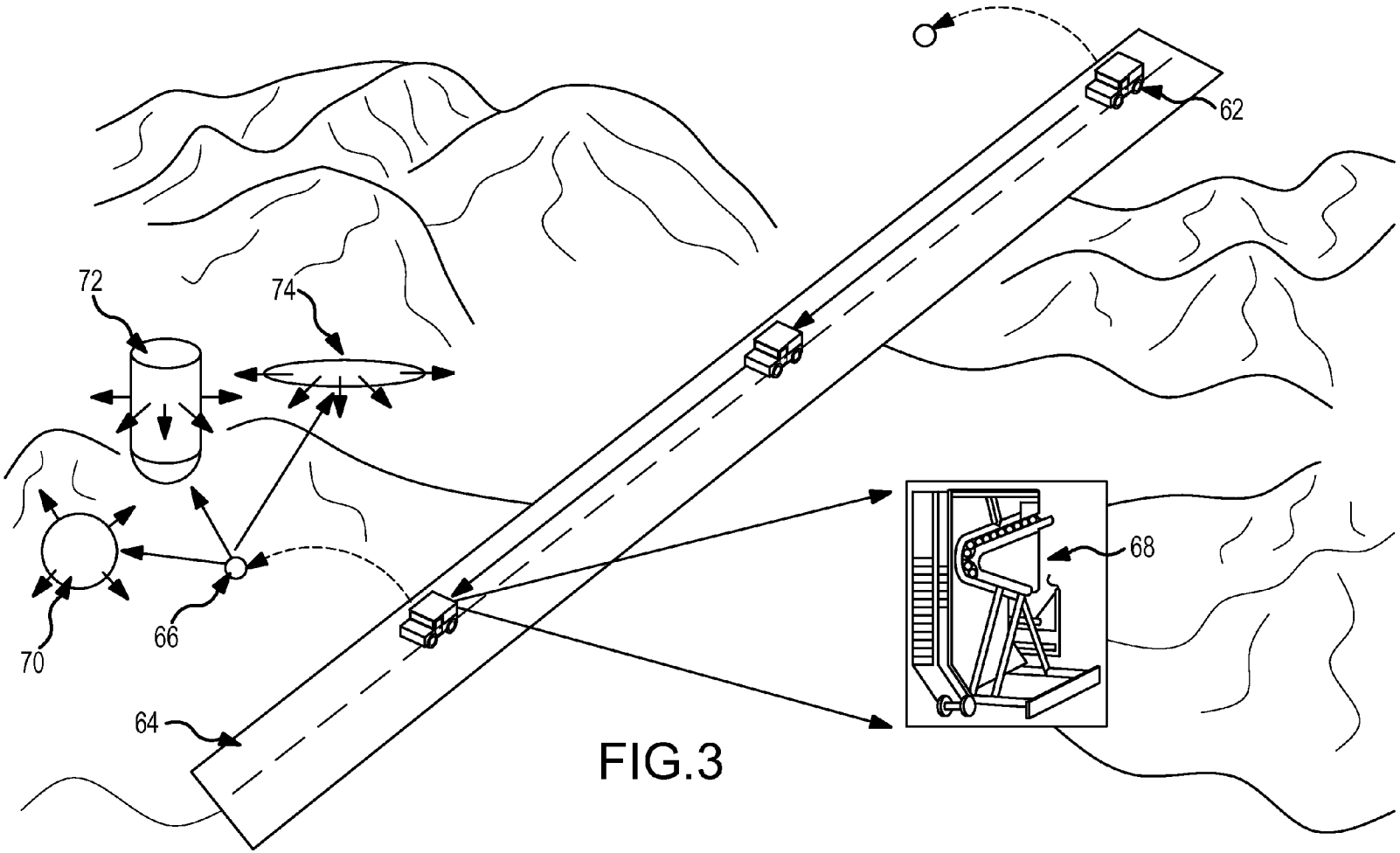
FIG. 3 is a diagram illustrating the deployment of nodes along the side of the road.

As shown in FIG. 3, personnel drive a HMMWV 62 down a road 64 and "throw" sensor nodes 66 out of the HMMWV to positions along the side the road. The sensor nodes may be thrown by hand or by a sensor deployment device (SDD) 68. An embodiment of an SDD resembles a baseball pitching machine that losses nodes 66 at approximately uniform spacing and distance from the road. The nodes are typically suitably spaced at 500 meters or less. The nodes are typically emplaced on the same side of the road to simplify the detection of passing vehicles and the determination of the direction of travel. The ability to detect and precisely locate delayed vehicles improves with node density but the network cost increases. The SDD may be configured with a geolocation receiver to measure and record the approximate geolocation of each node and provide the location information to the control station (if each node is not provisioned with a geolocation receiver). The SDD may also be configured to interact with each node as it is deployed and with the control station to perform or monitor the node emplacement tests. If the node fails, the SDD notifies a similar unit in a second trailing HMMWV to deploy a replacement node at the recorded geolocation of the failed node. Relay nodes (if used) may have a larger footprint due to additional power requirements for remote communications (e.g. long-range RF). As such it may be prudent to manually emplace the low-density relay nodes below the surface level so that they are not easily detected.

To avoid manual emplacement and alignment of the sensor nodes, the node and the one or more sensors within the node are preferably configured to provide a certain degree of freedom with respect to how the node lands. In particular, the node is preferably insensitive to its rotational orientation (as it lands) with respect to the monitored section of the road. If the node is required to land with a certain orientation but once it does is insensitive to rotation, we term that a "rotation insensitive" node. If no constraints are placed on the landing orientation of the node the node is said to be "omni-directional". As shown in FIG. 3, an example of an omni-directional node 70 could be a roughly round package, although other shapes may be used, that can sense a passing vehicle in any direction, no constraints are made on the placement orientation of the sensor. An example of a rotation insensitive node 72 would be a cylindrical package that can sense a passing vehicle 360 degrees radially in a cone about its long axis. The package is emplaced so the long axis is nominally perpendicular to the ground. This may be achieved, for example, by weighting the bottom of package. In one embodiment, a heavy sand filled back will cause the node to land on its bottom and remain right side up. Another example of a rotation insensitive node 74 would be a saucer or Frisbee™ shaped package that can sense a passing vehicle 360 degrees radially in a cone about an axis perpendicular to the center of the Frisbee. The saucer-shaped sensor node will land on either its top or bottom surface and may be shaped and/or weighted so that it will land on a preferred surface.

Sensor Node

Figure 4:
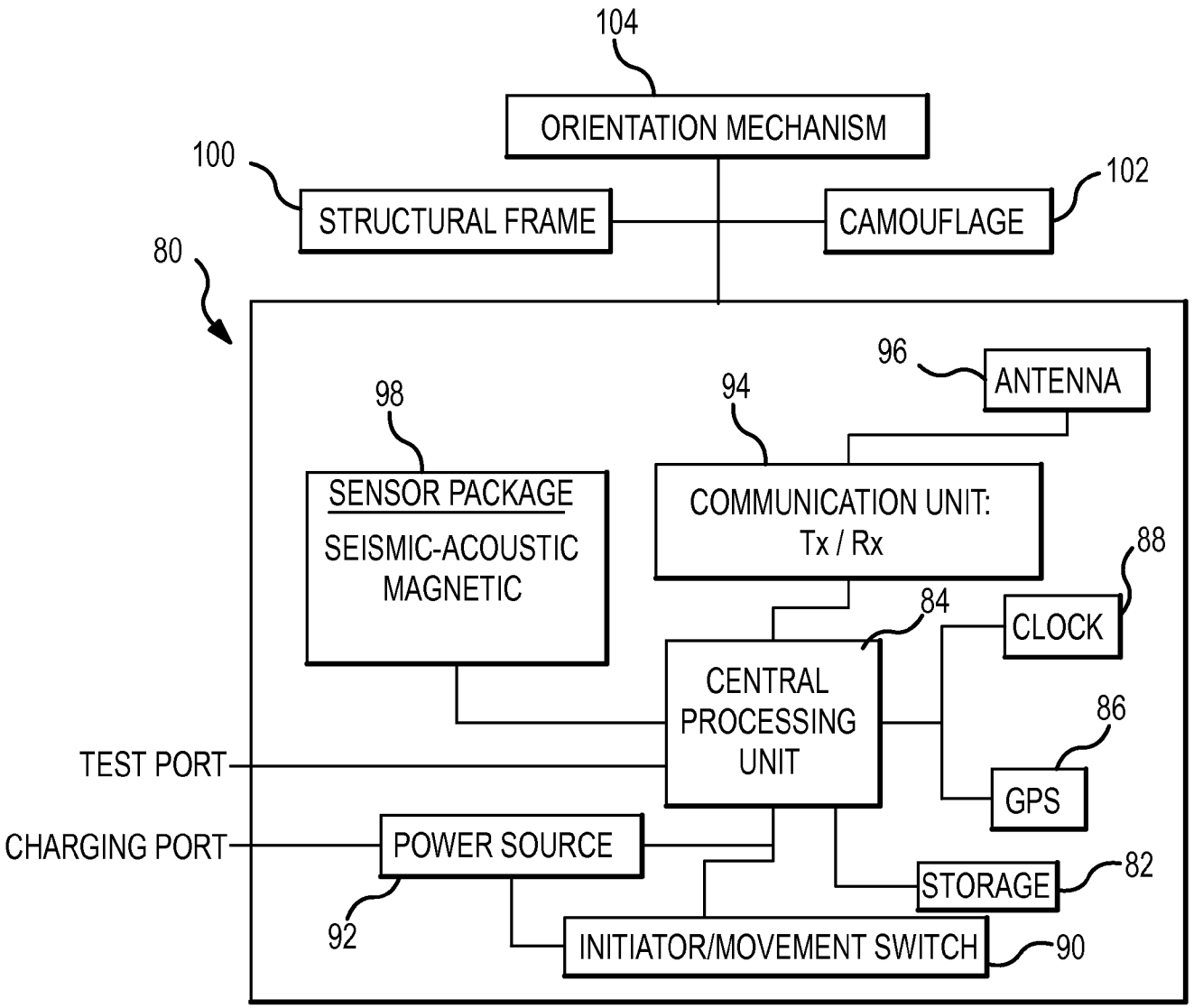
FIG. 4 is a block diagram of an embodiment of a sensor node.

In an exemplary embodiment shown in FIG. 4, a Sensor Node 80 is a self-contained unit consisting of storage 82 that stores instructions for executing the emplacement tests, collecting and processing calibration data and for executing the various operational modes and stores data, a central processing unit (CPU) 84 for executing the instructions stored in memory and controlling other node components, a geolocation receiver 86 such as a Global Positioning System (GPS) for providing the geolocation of the node and a clock 88 that is synchronized to the other nodes and control system. The integration of GPS in each node ensures a reliable and precise geolocation of the nodes, to improve location accuracy of the reported anomalous behavior. GPS also enables an anti-tamper mode to detect and track movement of the node after emplacement. The GPS time code may be used to provide the synchronized clock. An initiator/movement switch 90 turns on the node's power source 92 in response to emplacement landing shock, and is also used to alert CPU 84 if the sensor node is moved following its initial emplacement.

A communication unit (Tx/Rx) 94 and antenna 96 provide capability to communicate with nearby Sensor Nodes (or Relay Nodes). A local Radio Frequency (RF) system may be used. The communication unit 94 may be configured to receive remote communications from the control system but not with the capability for direct transmission to the control station. In this case, either the Sensor Nodes must be connected in a string with the last Sensor Node close enough for direct communication with the control station or Relay nodes must be emplaced to relay communications from the Sensor Nodes to the control station. Each sensor node is aware of its position in the string due to downloaded instruction from the control station, thus is can pass relay messages to its neighbor closer to the control station. Alternately, the communication unit may be configured with the capability (e.g. variable transmit power or a secondary remote RF capability) for direct communication with the control station.

A sensor package 98 includes one or more sets of different types of sensors with each set including one or more sensors of the same type. For example, the package may include 8 magnetometers and 8 seismic-acoustic sensors to provide 360 degree coverage for a rotation insensitive node. There are various types of sensors that could be integrated into the deployed sensor nodes. These include magnetometers, acoustic, seismic, infrared, radar, radio frequency, or laser to name a few. Sensors could also be clustered in a node to provide a wider spectrum of vehicle detection with lower false alarm rates and reduced probability of missed detections. Trade-offs of each sensor and sensor combination should be held to determine the best solution given the mission and the constraints of cost, size, weight, power consumption, and operational environment. The sensor node is preferably designed to be sufficiently inexpensive that sensor nodes can be abandoned in-place when power is depleted.

Figure 5:
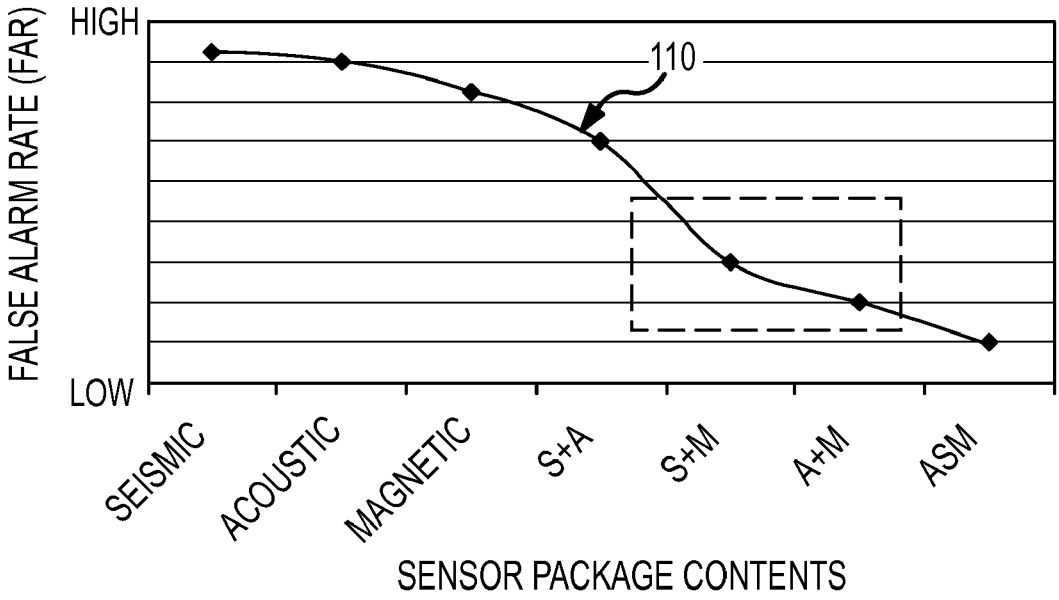
FIG. 5 is a plot of false alarm rate against sensor technology and combined sensor technologies.

A plot 110 of false alarm rate (FAR) versus sensor package configurations is illustrated in FIG. 5. The FAR refers to the number of detections reported by the system that are not due to anomalous behavior of vehicle traffic. A detection that would be classified as a false alarm could be caused by sensor malfunctions or by environment elements (e.g. animals, etc). The FAR is distinguished from the Nuisance Alarm Rate (NAR) that refers to the number of detections reported by the system that are due to vehicle traffic, but not illegal or threatening traffic of interest to the mission. Examples include a driver stopping to change a flat tire or a car being driven much slower than the expected speed. The Detection Rate (DR) of the system refers to the correct detection of threatening or illegal behavior associated with the vehicle. As shown by plot 110 in FIG. 5 the combination of a magnetometer with either an acoustic sensor or a seismic sensor yields a low FAR. The acoustic and seismic sensors are each examples of a vibration sensor; sensing vibrations produced by the passing vehicle through the air and through the ground, respectively.

Unlike conventional sensors for monitoring macro traffic or issuing traffic citations, the external packaging of the NeT-BUGS node is important to accomplish mission objectives. The Sensor Node may have a structural frame 100 that is small in size, does not stand out in the local environment and is rugged enough to withstand being thrown from the deployment vehicle. The frame will typically include camouflage 102 (e.g. color, texture, shape etc.) to further blend in with the local environment. As the Sensor Nodes may be deployed in hostile territory they will depend on small size, irregular geographic distribution and camouflage (e.g. resemblance to stones) to prevent detection. Unless the node is omni-directional, the node is suitably provided with some type of orientation mechanism 104 to ensure or increase the probability that the node lands and is emplaced with the desired orientation. For example the mechanism 104 in the case of a Frisbee™-shaped node is the shape of the structural frame. The Frisbee™ will almost invariably land on one of its two large faces. Alternately, for the more cylindrical node mechanism 104 may be a heavy bean bag that causes the node to land right side up and stay there. Another approach would be to include a simple robotic leg-extender that deploys after landing to flip the node to a desired orientation. The orientation mechanism 104 may comprise a sensor to measure the orientation at which the node landed and configure or calibrate the node sensor accordingly. For example a gravity sensor or light detector could determine whether a node landed up or down.

Omni-Directional Node

Figure 6B:
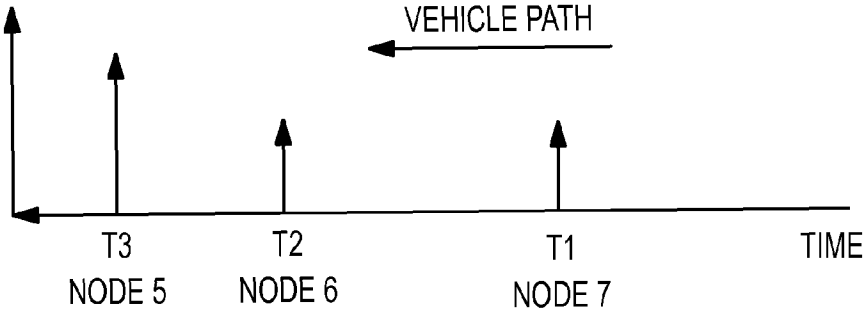
FIGS. 6*a* through 6*c* are an embodiment of an omni-directional node.
Figure 6C:
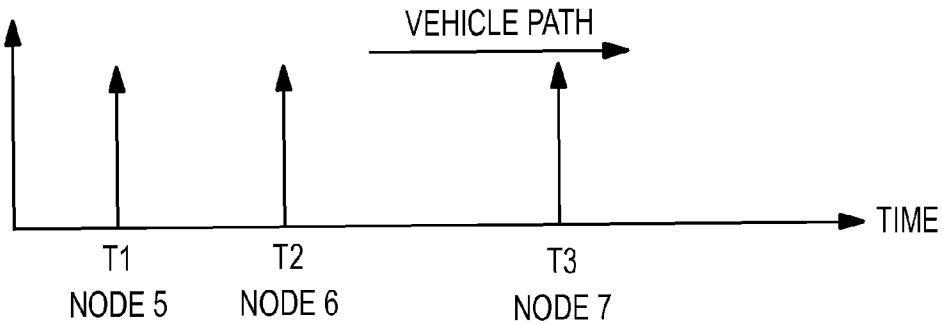
Figure 6A:
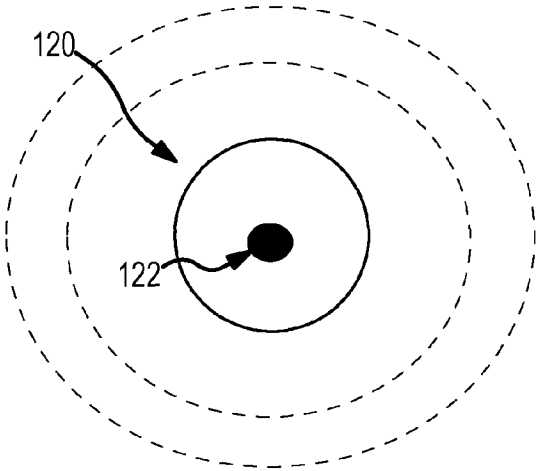
Figure 7B:
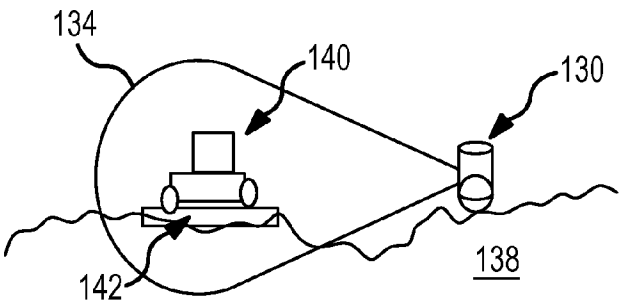
FIGS. 7*a* through 7*d* are diagrams illustrating an embodiment of a rotational-insensitive node.
Figure 7A:
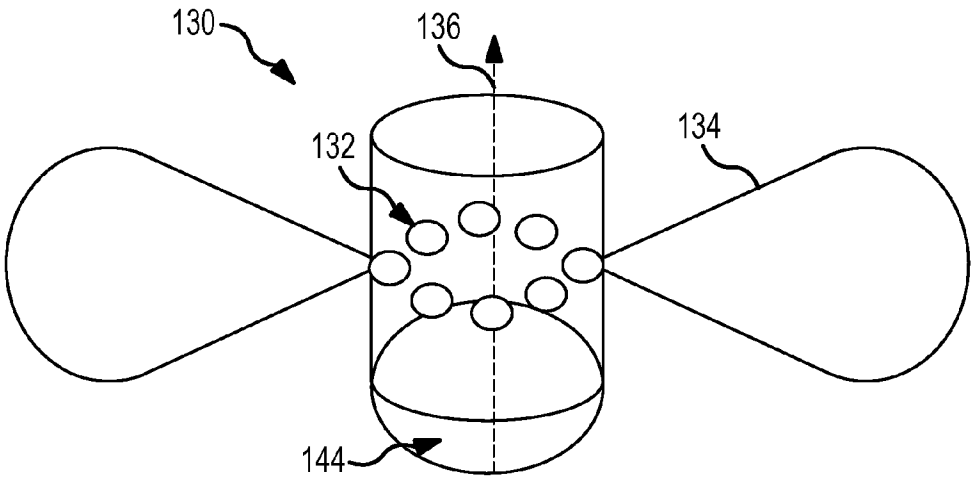
Figure 7D:
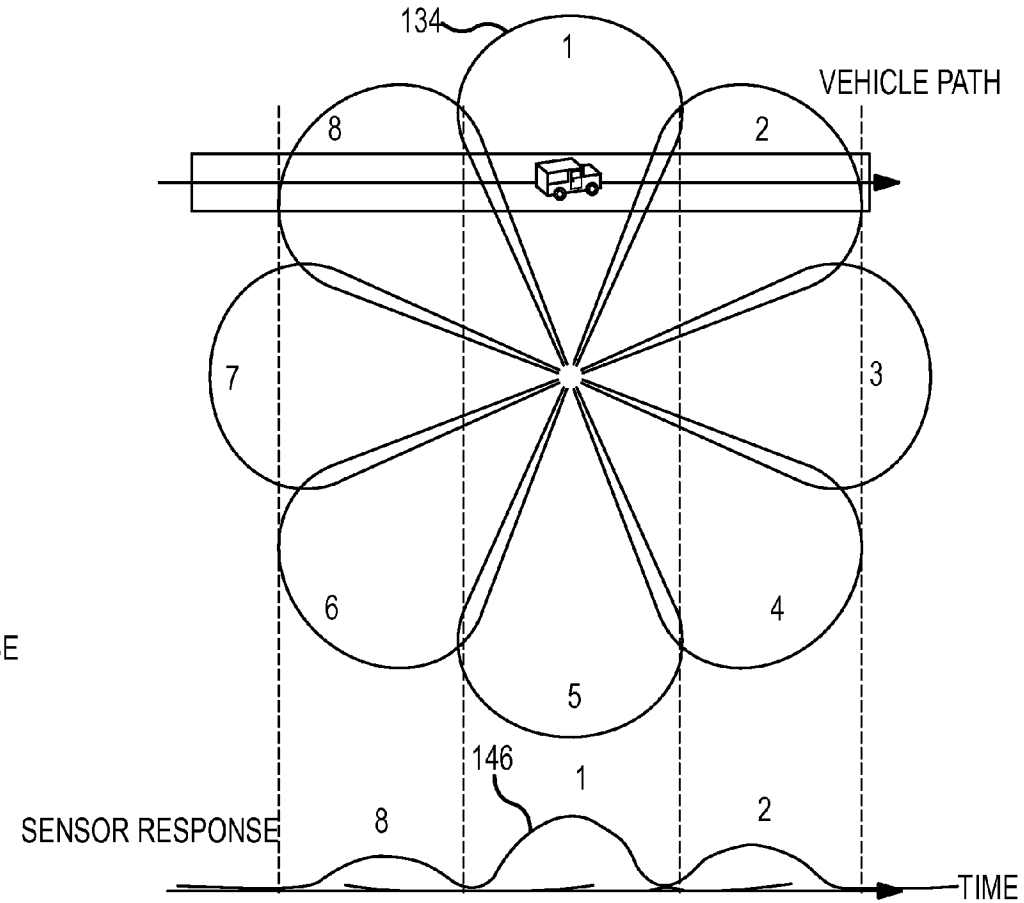
Figure 7C:
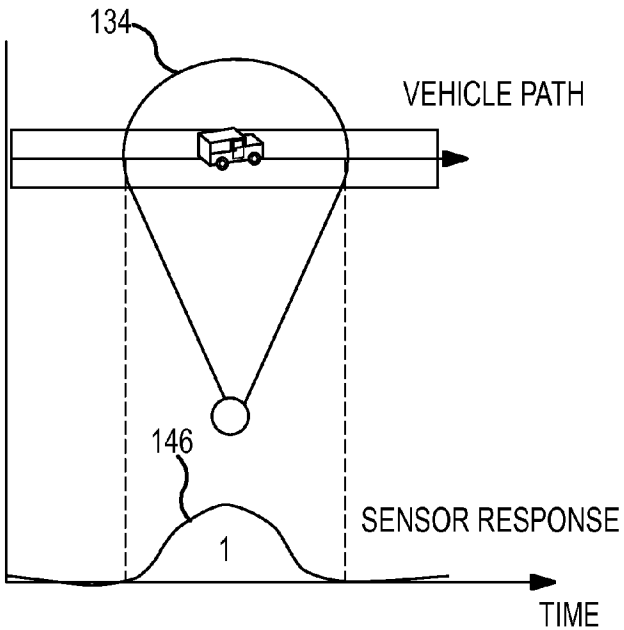

An embodiment of an omni-directional sensor node 120 is shown in FIG. 6*a*. In this particular configuration a single acoustic sensor 122 senses the acoustic signal of vehicles passing in either direction. The detection sensitivity may not be uniform in all directions. This may be improved by using multiple acoustic sensors whose directional lobes combine in a complementary fashion. Consequently the node may be deployed and emplaced with any rotational orientation.

In this particular configuration, the single acoustic sensor 122 can detect a passing vehicle from its acoustic signature and provide a time stamp when the vehicle passes the node (e.g. the point where the acoustic signal reaches a maximum). However, the direction of travel of the passing vehicle cannot be determined (or determined easily with confidence) from the acoustic signature of a single sensor. As shown in FIG. 6*b*, current Sensor Node 6 uses information forwarded in the detection message from adjacent Sensor Node 7 to determine vehicle direction. If based on the time stamp and direction provided in the detection message broadcast by Sensor Node 7, Sensor Node 6 expects to detect a passing vehicle within a specific time increment and does in fact detect the anticipated passing vehicle Sensor Node 6 can assume the direction of the passing vehicle is from Sensor Node 7 towards Sensor Node 6. Conversely, for FIG. 6*c*, the direction of a vehicle traveling from Node 5 to Node 6 will be correctly identified. If both Sensor Nodes 7 and 5 generate detection messages at approximately the same time, indicative of two vehicles passing Sensor Node 6 in opposite directions at roughly the same lime the problem is solvable but somewhat more ambiguous. In this case Sensor Node 6 calculates which vehicle should reach Node 6 first and assumes that directionality. Note, even if this middle Sensor Node 6 gets confused the network should accurately detect and track the two vehicles as they travel through the remainder of the network. Although nodes possessing a single sensor configuration may require additional processing at each node to determine direction, the power and node-cost savings may be cost effective in certain applications. Furthermore, the omni-directional nodes in a sensor string may be placed on both sides of the road and switch back-and-forth without complicating the determination of the direction of travel of passing vehicles.

Rotational Insensitive Node

An embodiment of a rotation insensitive sensor node 130 is shown in FIGS. 7*a* through 7*d*. In this particular configuration, eight magnetometers 132 each having 45 degree conical detection lobes 134 are placed to provide 360 degrees of sense capability around a long axis 136 of the node. A like set of eight acoustic or seismic sensors could be placed in the node to improve detection and reduce false alarm rate. As long as the node is emplaced right side up with axis 136 nominally perpendicular to the ground 138, the node can detect passing vehicles 140 on a road 142 in 360 degrees (i.e. it is insensitive to rotation about the axis). In this particular embodiment, a weighted bean bag 144 (or spike or weight) is positioned at the bottom of the node to lower the center of gravity beneath the aerodynamic center of the node. When the node is thrown, this causes the node to flip bean bag side down and land right side up to the side of road 142. The sensors are configured so that a passing vehicle (in either direction) is detected sequentially by at least two sensors (to provide direction). Each of these sensors generates an output response 146 that roughly resembles a raised cosine function as the vehicle passes. The node determines the direction of the passing vehicle from the temporal sequence in which the individual output responses go high, combined with input from the control station furnished after emplacement which informed the node which side of the road it is on. For example, 8-1-2 indicates a vehicle traveling left-to-right. The use of multiple sensors (per set) improves accuracy, target discrimination and tamper resistance.

In general, desirable characteristics of each sensor subsystem or element (e.g. each magnetometer, acoustic or seismic sensor) include sufficient sensitivity from its emplaced position to detect target vehicles traveling along the road. The sensors in each set have detection patterns (of lobes) that allow a degree of discrimination as to where in the pattern the target vehicle is, and also to guard against the potential for a single fixed-position jammer to defeat the node. The sensitivity is sufficient that each target vehicle is detected by at least two adjacent sensor elements of the same type in their detection lobes. The sensor elements have a reasonably wide vertical detection aperture as viewed from the side of an emplaced node to tolerate a degree of imperfect right-side-up alignment. The sensor elements of each sensor type are connected to the central processing unit in the node in such a way that the processing unit is aware of the order of sensor responses due to a passing target vehicle. The central processing unit can use the input from a sensor element of a given sensor type to approximately determine the instantaneous radial position of the target vehicle in a sensor lobe. The processing unit receives information from the Control Station that enables the processing unit to associate the order of detection by the sensor elements of each type with the target vehicle's direction of travel.

In general, the processing unit in each NeTBUGS node, making use of information furnished by the Control System, must "learn" which sensor elements are sensitive to passing target vehicles and accommodate a range of responses due to differences in vehicle characteristics and differences in range (due primarily to direction of travel producing a range offset). The processing unit in each node, using output levels from each sensor element, must "learn" to disregard the outputs from sensor elements not impinged on by target-vehicle traffic. Sensor elements 3 through 7 in the illustrated example FIG. 7*d*. However, there may be anti-tamper or other reasons for retaining the inputs from otherwise-unused sensor elements. Dependent upon the characteristics of the sensor elements, the processing unit in each node may also need to periodically calibrate out background signals and/or remove sensor-element biases which would otherwise build up and decrease the sensitivity.

Network Emplacement and Calibration

Figure 8:
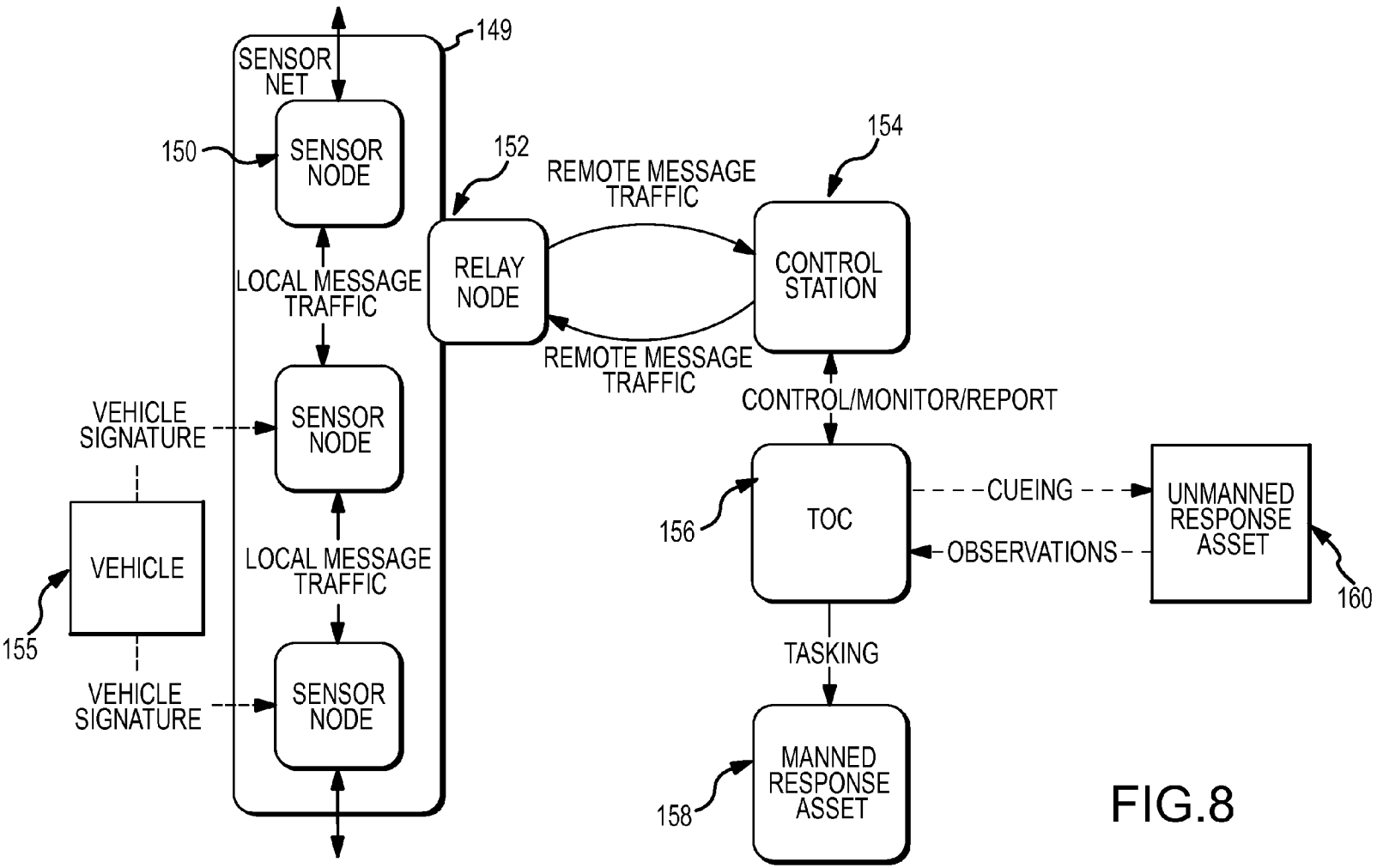
FIG. 8 is a diagram illustrating the detection of a vehicle and data flow among the nodes, control station, tactical operations center and other manned and unmanned response assets.
Figure 9:
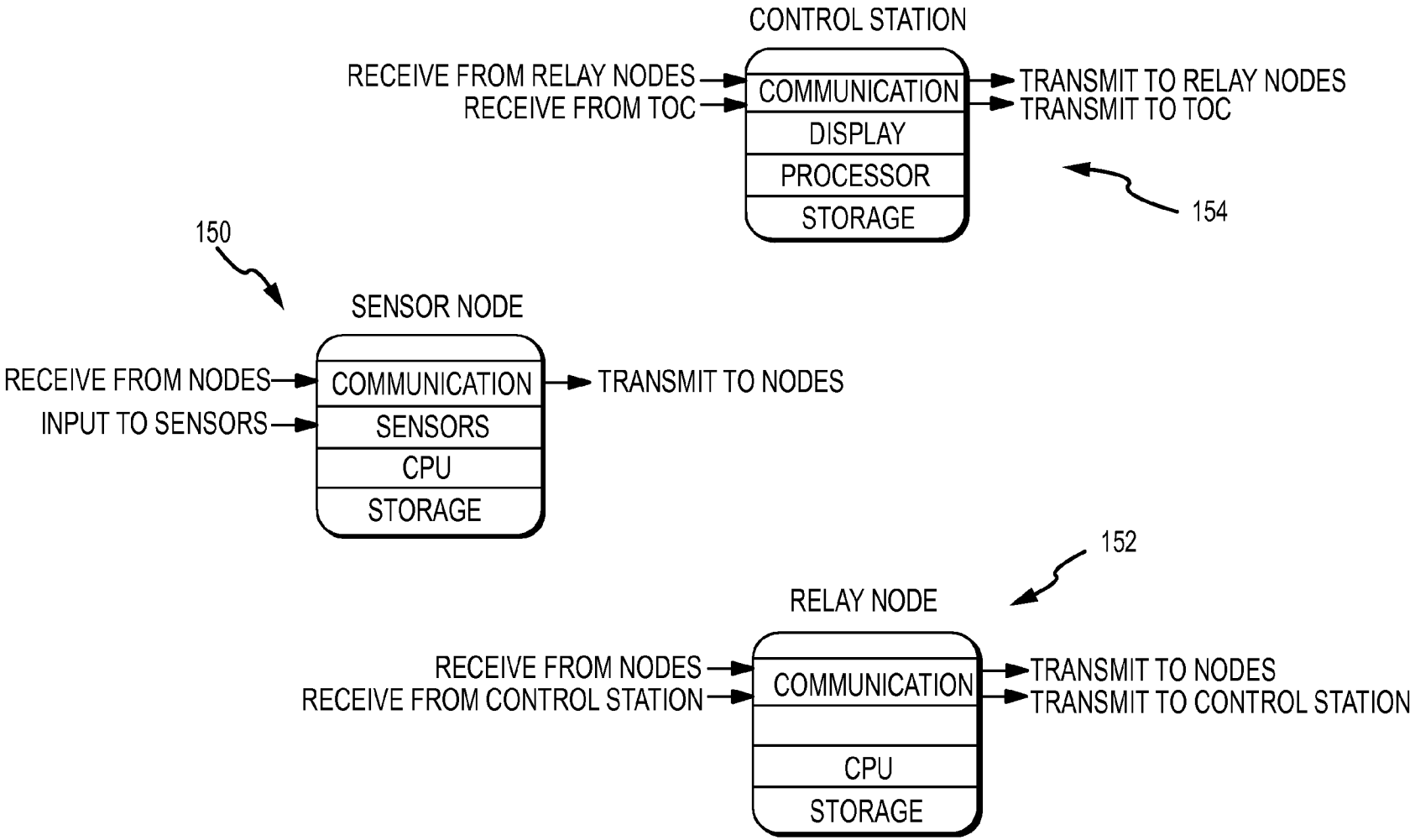
FIG. 9 is a diagram of data flow to and from the sensor nodes, relay nodes and control station.

A portion of a NeTBUGS network 149 and the message traffic to and from Sensor Nodes 150, Relay nodes 152 and Control Station 154 is depicted in FIGS. 8 and 9. The modes supported by NeTBUGS and the remote command and control or the nodes to execute these modes are depicted in FIGS. 10 and 11. Once the individual components (e.g. sensor and relay nodes and the control station) are emplaced and their individual functionality verified through various tests the "network" must be tested; the message traffic between components established and verified, the topology of the network established and propagated, the clocks synchronized, the functionality of each operational mode verified and the remote command of those nodes verified, etc.

In this particular embodiment, Relay node 152 simply relays message traffic between the Sensor Nodes 150 and the Control Station 154. The Relay node 152 is not in this embodiment provisioned with sense capability. In this embodiment, all message traffic from Control Station 154 passes through Relay node 152 for distribution to Sensor Nodes 150. In many embodiments the Sensor Nodes 150 would be configured to receive message traffic directly from the Control Station. In other embodiments the Sensor Nodes 150 could be communicating with multiple Relay nodes 152 which in turn are communicating with Control Station 154. Sensor Node 150 receives as inputs message traffic from other Sensor Nodes 150 and Relay nodes 152 and the signatures of passing vehicles 155 and transmits message traffic including detection and alert messages and other messages to adjacent Sensor Nodes 150 and Relay nodes 152. Message traffic may need to transit multiple Sensor Nodes 150 before reaching Relay node 152. Relay node 152 receives message traffic including alert messages from Sensor Nodes 150 and transmits that message traffic to the Control Station 154 and receives message traffic from the Control Station 154 and transmits the message traffic to the Sensor Nodes 150.

Each of the network components performs various tasks and generates message traffic in response to those various tasks passed through the network. Sensor Nodes 150 perform BIT, health and status check periodically and generate message traffic that is passed to the Control Station. The Sensor Nodes, Relay nodes and Control Station will also execute different tests of communication and message traffic to ensure communications are functional and transfer data such as Sensor Node geolocations, operational status etc. up to the Control Station and node identifiers, network topology, node location relative to the road, etc, down to the Sensor Nodes.

Once emplaced, the network and the individual sensor nodes are then calibrated for particular mission objectives and local traffic behavior. The Sensor Nodes are typically calibrated to detect passing vehicles with a high likelihood of detection and a low false alarm rate and to determine the direction of the passing vehicles. The Sensor Nodes may be calibrated to adjust local transmit power levels for communication among adjacent nodes to ensure the lowest transmit power consistent with robust communication. To configure power management mode, the control station may command each node to collect statistics for a sample period on vehicles passing (time and direction of passing), request, receive and process the statistics from each node to determine traffic-flow parameters vs. location and time of day (and perhaps day of week, holiday, etc in addition), determine the likely periods of useful sensor effectiveness and propagate active/standby times to all nodes. The operator of the Control Station may tailor the active/standby times based on local intelligence of the traffic behavior to be monitored.

Figure 12:
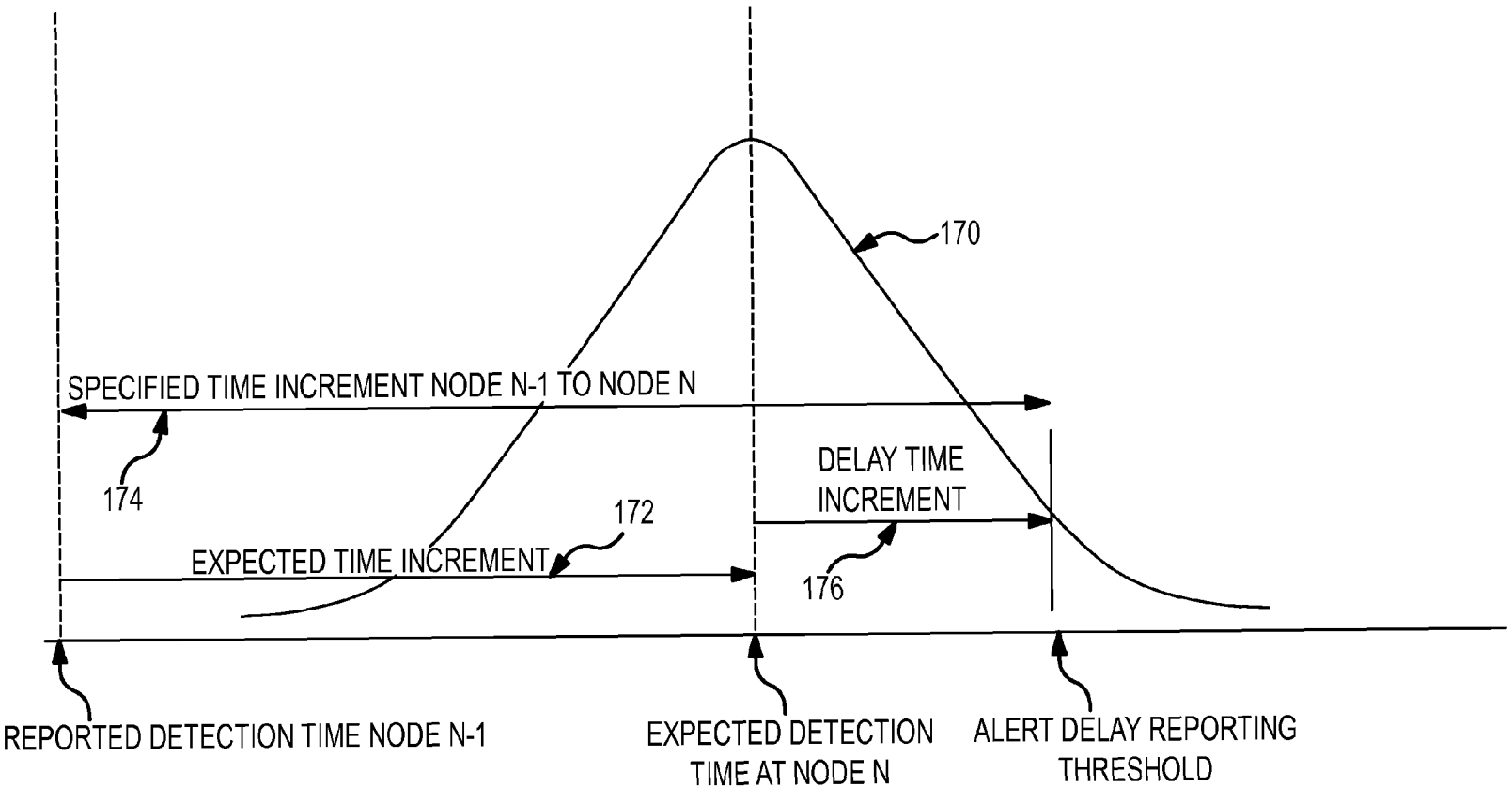
FIG. 12 is a diagram of the expected time increment and statistical distribution of the delay time increment that are combined as a threshold to trigger a delay alert when the previous node along the path of vehicle travel reported a vehicle detection and the vehicle passes the next node after the threshold time.

Lastly, each Sensor Node is typically calibrated to local traffic conditions to determine the expected time increment for a vehicle to pass from an adjacent Sensor Node to that node in order to set the specified time intervals at each node for the vehicle delay mode. Typically, each sensor node will gather statistics regarding traffic patterns. This data may be used to directly establish each node's expected time increment (measured from the time stamp on a reported detection from an adjacent node). As shown in FIG. 12, for a Sensor Node N a number of data points of actual time increments for vehicles to pass from Sensor Node N−1 to Sensor Node N are accumulated. These data points define a distribution 170. The expected time increment 172 for a vehicle to travel from Node N−1 to Node N may be set at the expected value of distribution 170. Note, the expected time increment for a vehicle travelling in the opposite direction from Node N+1 to Node N may be different due to variations in node spacing, or road conditions that affect typical vehicle speeds. The raw data may be transmitted back to the control station and aggregated and possibly combined with external sources of information regarding the mission or local traffic conditions (e.g. posted speed limits) to determine the expected time increment, which are then transmitted back to the respective nodes.

The specified time increment 174 from Node N−1 to Node N is the sum of the expected time increment 172 plus a delay time increment 176. This delay time increment can be specified in multiple ways for different reasons. One approach is to specify a fixed multiplier of the expected time increment. For example, a multiplier of 1.25 would mean that if the vehicle doesn't arrive within a delay time increment equal to 25% of the expected time increment, the wait to detect the anticipated vehicle has exceeded the threshold and the node issues an alert delay message. Another approach is to specify the delay time increment in terms of an x-sigma event, where the x is configurable and may vary from sensor node to sensor node and sigma is the standard deviation of distribution 170. For example, if x=1.1, if the additional delay in waiting for the anticipated vehicle to pass is greater than 1.1 sigma the node issues an alert delay message. Yet another approach is to simply specify a vehicle stop time that the network will detect and alert on. For example, if the TOC wants to raise an alert any time a vehicle stops for more than 20 seconds, the delay time increment is set to 20 seconds for each node. Yet another approach is to simply allow an operator to make the threshold more or less sensitive to select an acceptable nuisance alarm rate. The TOC will typically have only a certain capability to dispatch assets, hence if the total number of nuisance alarms issued overwhelms the capability to respond the TOC may increase the threshold.

Although the primary mission is to detect anomalous vehicle behavior in the form of stoppage or delays, the node thresholds may be also be configured to alert on vehicles that arrive suspiciously faster than the anticipated increment. In other words, the vehicle is travelling at much higher rate of speed than anticipated. This might be particularly suspicious if the vehicle is travelling at approximately the anticipated speed through the network and than rapidly accelerates. Any of the multiplier, x-sigma or fixed time increments can be used to decrement the expected time interval to set a low alert threshold. The delay-time increments used for high-speed alert and low-speed alert need not be identical.

Once emplaced and calibrated, the network can be used in one or more of its operational modes listed in FIG. 10 to detect individual vehicles throughout the network, identify anomalous behavior (delays or early arrivals) of vehicles, track the identified vehicles throughout the network and generate alerts leading to tasking manned or unmanned response assets to investigate (e.g. track the identified vehicle to its destination and/or investigate the area in which the stoppage was detected). As listed in FIG. 11, these modes can be remotely enabled/disabled and otherwise controlled remotely from the control station. This provides the Control Station operator flexibility to adapt the network as mission parameters or local traffic behavior change.

Power Management Mode

The power management mode controls when the Sensor Node is operational and when it is in power-conserving standby mode. A unique aspect of NeTBUGS is that the operational times correspond to low-density traffic behavior. Limiting the use of NeTBUGS to low-density traffic is a key enabler. Unambiguously detecting passing vehicles, determining whether a particular one has exceeded a delay threshold and tracking that vehicle through the network would exceed the detection and processing capabilities of the system if applied to high-density traffic. Fortunately the mission of NeTBUGS to monitor illegal or threatening behavior is well suited to its capability. Such activity is not typically conducted during peak traffic conditions. The targeted behavior is more likely to occur on rural roads during the middle of the night when traffic is very low.

The determination of the operational and standby times may be determined solely based on traffic flow statistics gathered by the network so that the nodes are active only during sufficiently low-density periods. Typically, all of the nodes would have the same operational and standby periods. However, if the network is very large the times may vary. More typically, the statistics are forwarded to the control station, which considers both the traffic flow statistics as well as operational knowledge of the mission and the local environment to set the operational and standby times that are then broadcast back to the sensor nodes.

Vehicle Detection Mode

Each of the sensor nodes in the network is enabled to detect the passing of vehicles and upon such detection to transmit a detection message. The detection message includes a message identifier, a node identifier, a lime stamp and a direction of travel of the passing vehicle. The detection message is transmitted so that at least the adjacent sensor node in the direction of travel receives the message. These local detection messages are ordinarily not passed to the control station.

An alert option may be enabled in which the detection message is identified as an alert. As such, the detection message is not only transmitted to the adjacent sensor node to initiate execution of delay mode by that node but is also passed to the control station. In certain circumstances the TOC may want to know when any vehicle enters the network and passes a node; this capability can also be used to report continuously on all vehicles in the network. As described below, this alert detection mode can be used to track a vehicle that has been identified as potentially suspicious (e.g. a delay in travelling between two consecutive nodes in the network). As a variant to the alert option, the alert may be set to only trigger if a node detects a certain density of vehicles (e.g. X vehicles detected in Y minutes) as such a density of traffic during what is expected to be a period of low-density traffic may be an indicator of illegal or threatening behavior. The alert option and the density variant may be remotely enabled/disabled via the control station.

Vehicle Delay Mode

Each of the sensor nodes in the network (except perhaps those on the ends) are enabled to monitor individually detected vehicles for delays that raise a suspicion of illegal or threatening behavior and upon detection of such a delay to transmit an alert delay message that is passed to the control station for analysis and dispatch of an asset to investigate the suspicious behavior. The alert delay message includes a message identifier, a node identifier, a time stamp and a direction of travel of the anticipated but not detected vehicle. Control station 154 receives message traffic from Relay nodes 152 and the TOC 156 via computer or the human computer interface such as mission relevant data, external sources of information on local traffic behavior, detection sensitivity etc and transmits message traffic back to the Relay nodes 154 and the TOC 156. In particular, the Control Station will pass on location and lime of possible illegal or threatening vehicle behavior derived by the Control Station from the alert delay messages and other data to the TOC, leading to the deployment of manned response assets (MRA) 158 and/or unmanned response assets (URA) 160. The TOC provides cueing to the URA such as an unmanned aerial vehicle (UAV) to investigate the area where the anomalous behavior was detected and return imagery of the target vehicle or the area in which the vehicle stopped. The TOC staff analyzes the imagery to determine the appropriate follow-up action. The TOC may also task the MRA to track and possibly intercept the target vehicle or to investigate the area of stoppage.

As described previously, the control station may enable each sensor node to collect and analyze traffic statistics to determine the expected and/or delay time increments. Alternately, the control station may transmit these parameters to each of the sensor nodes. These parameters may be determined in whole or in part by statistics provided by the individual sensor nodes.

A tradeoff exists at the setting of the delay time increment—lowering the threshold will increase the detection rate but will also increase the nuisance alarm rate. Conversely, increasing the threshold (making it more difficult to trigger a detection event), reduces both the NAR and DR. The settings are heavily influenced by the environment in which the NeTBUGS system is deployed. Depending upon the number of available assets to follow up with the detection events, the tolerance for NAR and FAR will vary. Based on these variables, a configurable threshold value is a necessary and useful feature of the NeTBUGS system.

A nuisance alarm may be triggered by a vehicle that is travelling at a speed that is significantly lower than that predicted by the statistics for the node. For example, under ideal conditions a specified time increment (threshold) set for a node-to-node spacing of 1 km to detect a 2 min stop at 45 mph will create a nuisance alarm for a vehicle travelling at a constant speed of 13.2 mph or slower. At a spacing of 200 m, to detect a 1 min stop at 25 mph will create a nuisance alarm at a constant speed of 5.8 mph or slower. Conversely, a vehicle traveling at a significantly higher speed than anticipated could stop for a period exceeding the threshold and not trigger detection. These nuisance alarms and missed detections can be remedied to some extent by placing the sensor nodes more closely together.

An approach to both improve detection rate and reduce nuisance alarm rate is to pass forward the velocity history of a target vehicle from the previous N nodes and adapt the specified time increment (threshold) based on this history. More particularly, the velocity history can be used to refine or replace the expected time increment portion of the threshold. In the case of an abnormally slow vehicle the specified time increment would be increased and potentially avoid a nuisance alarm. Conversely, in the case of an abnormally fast vehicle the specified time increment would be reduced and potentially detect a suspicious stop by such a vehicle. This mode may be enabled or disabled via the control station.

An enhanced delay mode may be enabled for sensor node N+1 to continue to issue the alert message periodically until it detects the target vehicle previously reported by sensor node N, or times out after a specified time period. The additional alert message may reinforce or retract the original alert, provide additional information to pass situational awareness to the network or response asset to track the vehicle, or may be used to recalibrate the nodes/network. By sensor node N+1 continuing to issue the alert until it detects the vehicle passing, the approximate stop time may be estimated. This may either heighten or reduce interest in the target vehicle. Furthermore, these alerts tell the network and the TOC if, when and where the target vehicle starts moving again.

Vehicle Track Mode

Some or all of the sensor nodes may be enabled to execute a track mode. If track mode is enabled, when a sensor node reports an alert delay message, suspicious vehicle delay at node N, the vehicle detection alert option is enabled. The effect is that as the target vehicle reappears in the network, each sensor node will report an alert vehicle presence detection message that is passed to the control station. This allows the control station and TOC to "track" the vehicle as it travels through the network. This information may be useful to bridge the period between the issuance of the alert delay message and the ability of URA or MRA to be dispatched and acquire track continuity on the target vehicle. Track may be enabled either "locally" in which only the vehicle of interest is tracked within the network or "universally" in which all vehicles detected anywhere within the network are tracked. Track mode and the local/universal options may be remotely enabled/disabled from the control station.

Data Transfer Mode

To support maintenance of the nodes and network and vehicle detection and tracking functions of the sensor nodes, data must be transferred between the sensor nodes and control station. The sensor nodes may be programmed to periodically or as needed or when remotely enabled, transfer data to the control station. For example, a log of the detections made by each node, traffic statistics gathered, BIT, health, status etc. The nodes may also be enabled to receive data from the control station such as network reconfiguration to bypass failed, end-of-battery-life or missing nodes. The network is preferably deployed and configured so that no one sensor node is a single point of failure for the entire network.

Anti-Tamper Mode

In the event that a sensor node is moved after deployment, it immediately transmits a message indicating potential tampering. This message tells adjacent nodes and the control station that the node is compromised and should be removed from the network, and replaced if feasible. The node is suitably configured to shutdown the sensing functions and use all of its remaining available power to issue periodic anti-tamper alert messages. This message includes a message identifier, a node identifier, a time stamp and the geolocation of the node if available. In a limited configuration, the node is provisioned with a sensor (the Initiator/Movement switch 90 in FIG. 4) that can simply determine that the node has been moved after emplacement. In a preferred configuration, the node is also provisioned with a geolocation receiver that can accurately determine the last known position of the node before it was compromised and periodically broadcast the position of the node as it is moved. The TOC may dispatch an asset to track and potentially recover the node.

NeTBUGS: Border Enforcement

Figure 13A:
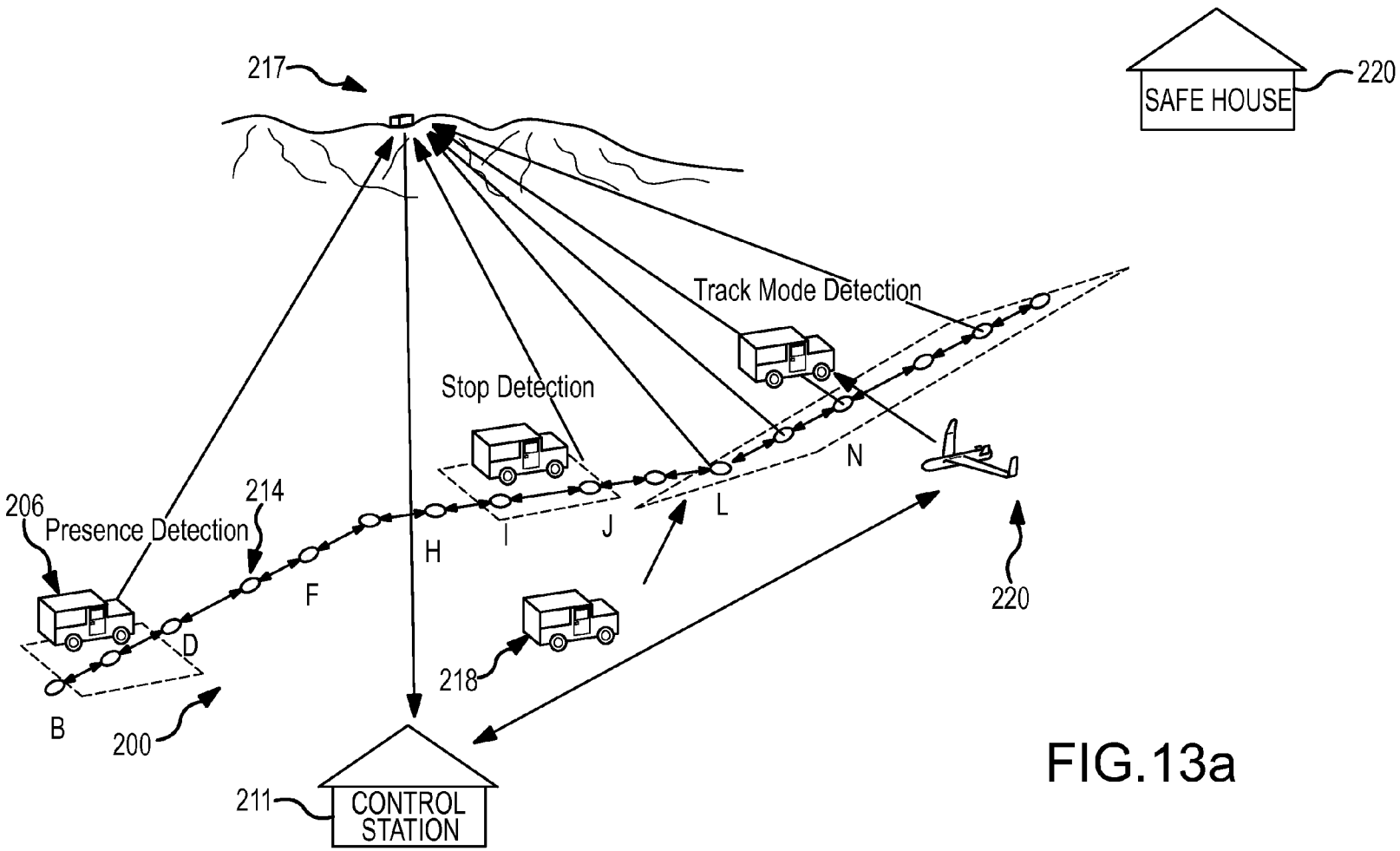
FIGS. 13*a* through 13*c* are respectively diagrams illustrating the use of NeTBUGS to detect the presence of a vehicle for border enforcement, to raise a delay alert to task an asset to identify the vehicle and to track the vehicle in the network until the asset can acquire, plots of recorded time stamps at successive sensor nodes and the detection and alert message traffic generated by NeTBUGS.
Figure 13B:
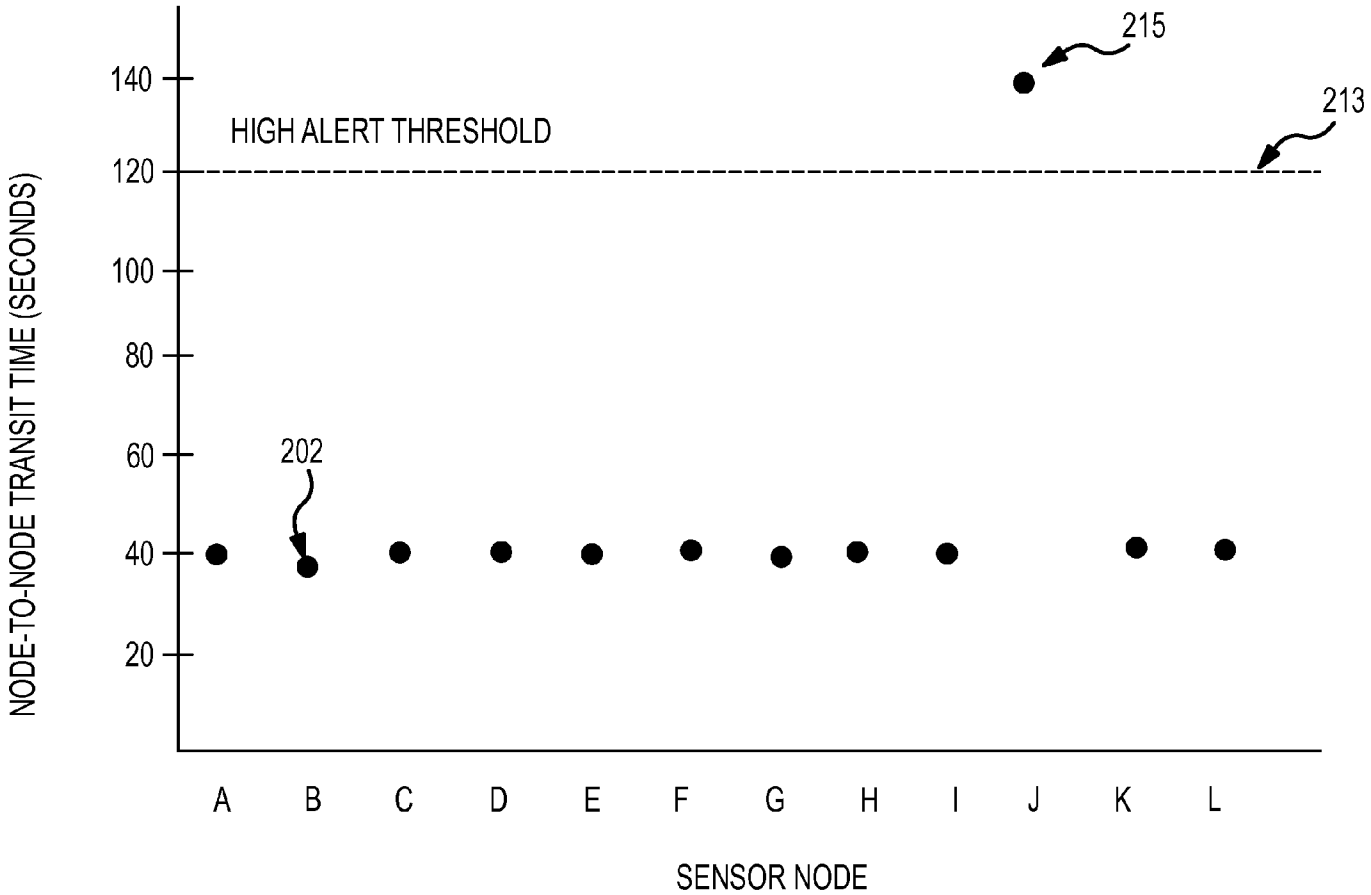
Figure 13C:
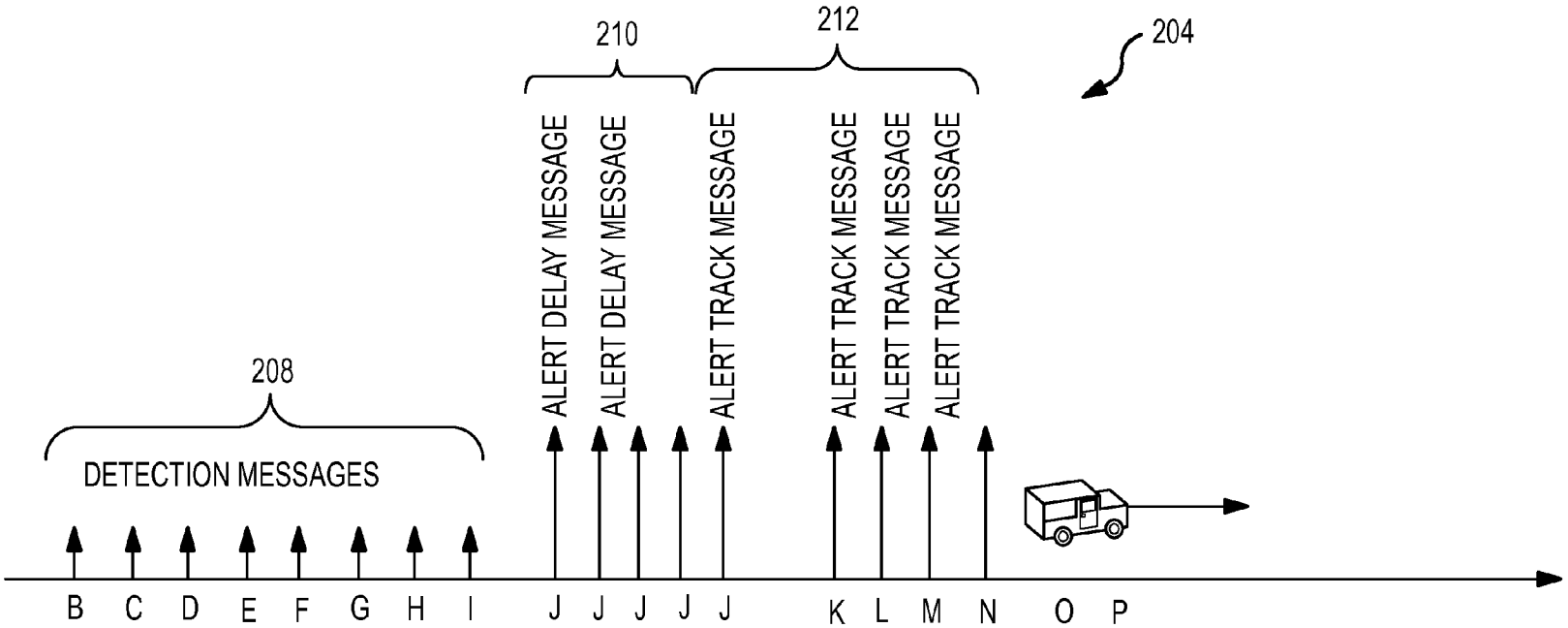

An exemplary NetBUGS system 200 deployed for border enforcement, the detected time increments 202 through the network and the message traffic 204 for detecting, alerting and tracking a target vehicle 206 is illustrated in FIGS. 13*a* through 13*c*.

In an exemplary scenario, the U.S. Customs and Border Patrol (CBP) deploys the NeTBUGS border security system on a network of 100 miles (200 Sensor Nodes 214 at 2 per mile density) of rural roads within 10 miles of the U.S.-Mexico border in an area known for heavy smuggling activity. The network is enabled in detection mode to issue local detection messages 208 to neighboring nodes, in delay mode to issue alert delay messages 210 to a control station 211 if a specified time increment following detection by an adjacent node, in enhanced delay mode to periodically reissue the alert delay message 210 with an updated time stamp until the vehicle is reacquired by the network and in local track mode to enable the detection mode alert option to issue alert track messages 212 that are passed to the control station. Calibration of the network determined that the average speed of vehicle traffic is 45 mph which corresponds to a 40 sec expected time interval between nodes. The delay time increment is set to 80 seconds. The specified time increment ("high alert threshold") 213 is 120 seconds. This threshold will prevent nuisance alarms on even very slow-moving vehicles of down to only 15 mph while detecting vehicle stops that exceed 80 seconds (assuming the vehicle is otherwise travelling at 45 mph).

At 2 am, the system generates an alert. A vehicle had been traveling at 45 mph and passing hidden sensor nodes 214 (A, B, C, D, . . . ) roughly every 40 sec generating detection messages 208 until the vehicle made a rapid 90 sec. stop to pick up 3 border crossers at a pre-arranged rendezvous point between sensor nodes I and J. The next sensor node J recorded a 130 second delay 215, which exceeded its 120 sec. threshold. Sensor node J issues an alert delay message 210 and repeats the message until the vehicle is reacquired by sensor node J at which point it issues an alert track message. The alert messages may be relayed via relay nodes via a remote comm. link 217 denoted by a communications satellite to the control station. The vehicle returns to traveling at 45 mph but the alert has caused the subsequent sensor nodes in the network to track the now acquired vehicle. As sensor nodes K, L, M, . . . , detect the passing vehicle on its way to a safe house 216 they each issue an alert track message 212 including the geolocation of the node and a time stamp.

The initial alert delay message issued by sensor node J is received at the control station 211, which alerts an operator. For example, the computer may cause an icon to flash at sensor node J on a displayed map of the sensor network with the type of alert, node identifier, time stamp, geolocation and direction of travel. As the vehicle is reacquired and tracked through the network, the computer may update the display to track the vehicle through the map. In response to the alert delay message, the operator may dispatch a MRA such as a HMMWV 218 to acquire and track the vehicle or a URA such as a UAV 220 to track the vehicle.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A network of traffic behavior-monitoring unattended ground sensors, comprising:

a plurality of autonomously-powered sensor nodes in an ordered network, each said sensor node having a programmable power management mode including standby and operations times corresponding to high and low-density traffic behavior, respectively, each said sensor node configured during operations to detect the time and direction of travel of a passing vehicle and broadcast via a communication link a detection message including a node identifier, the detection time and the direction and to receive detection messages from adjacent nodes, each said sensor node operating in a delay mode in which upon passing of a specified time increment from the detection time reported by the adjacent node without detecting the passage of the anticipated vehicle broadcasts an alert delay message including a node identifier, an alert time of vehicle non-arrival and the direction of travel via the communication link, wherein said network of sensor nodes has a calibration node in which the network detects passing vehicles to determine the standby and operations times for the power management mode and gathers statistics on the time increments of vehicles passing adjacent nodes in the network to determine the specified time increments for each said sensor node for the delay mode; and a control station including a computer configured to receive alert delay messages and, knowing the topology of the ordered network and the geolocation of each said sensor node, to facilitate timely dispatch of an asset to investigate the anomalous behavior of the vehicle.

2. The network of claim 1, wherein said plurality of sensor nodes are placed at most 500 meters apart along a monitored road.

3. The network of claim 1, wherein said plurality of sensor nodes are placed on the same side of the monitored road.

4. The network of claim 1, further comprising:

at least one autonomously-powered relay node configured to receive alert delay messages from sensor nodes via a local communication link and to rebroadcast the alert delay messages via a remote communication link to the control station.

5. The network of claim 1, wherein said sensor node comprises an acoustic or seismic vibration sensor and a magnetic sensor, which together detect the passing vehicle.

6. The network of claim 1, wherein the control station broadcasts control messages to the network of sensor nodes, said control messages including the times for the sensor nodes' power management mode.

7. The network of claim 1, wherein the control station broadcasts control messages to the network of sensor nodes, said control messages including the specified time increments.

8. The network of claim 1, wherein the detection message includes a history of actual time increments for the passing vehicle, said sensor node modifying the specified time increments based on the history to trigger the alert delay message for that passing vehicle.

9. The network of claim 1, wherein said sensor nodes have a detection mode in which the detection message is broadcast as an alert detection message that is received by the control station.

10. The network of claim 9, wherein the sensor node only broadcasts the alert detection message if the density of the number of passing vehicle detections over a specified unit of time exceeds a threshold.

11. The network of claim 9, wherein the control station broadcasts control messages to the network of sensor nodes, said control messages including a message to enable or disable detection mode.

12. The network of claim 9, wherein said sensor nodes have a track mode in which if a sensor node broadcasts an alert delay message at least the sensor nodes in the vicinity of that sensor node enable the detection mode and generate alert track messages upon detecting the vehicle.

13. The network of claim 1, wherein the control station dispatches the response asset to acquire and track the vehicle.

14. The network of claim 13, wherein the response asset is an unmanned aerial vehicle.

15. The network of claim 13, wherein the control station dispatches another response asset to verify the location where the vehicle stopped.

16. The network of claim 1, wherein each said node includes a geolocation receiver for measuring the geolocation of the node, said node sending a message to the control station including its geolocation.

17. The network of claim 1, further comprising:

a vehicle for delivering the sensor nodes;

a deployment mechanism for deploying the nodes along the side of a road;

a geolocation device for recording the geolocation of each sensor node as it is deployed;

a test mechanism for interacting with each sensor node immediately after deployment to determine the node's readiness for service; and a mechanism to alert a following vehicle to deploy a replacement sensor in approximately the same location as a failed sensor node.

18. The network of claim 17, wherein the geolocation of each sensor node is downloaded to the control station and broadcast to the sensor nodes so that each node is aware of its own geolocation.

19. The network of claim 1, wherein the node includes a plurality of sensors to detect passing vehicles at different orientations to the node, said node configured to determine the direction of the passing vehicle from the detection responses of said plurality of sensors and the sensor node's position in the network topology.

20. The network of claim 1, where said node is configured to determine the direction of the passing vehicle from the ordered network topology and the detection message received from an adjacent node.

21. A network of traffic behavior-monitoring unattended ground sensors, comprising:

a plurality of autonomously-powered sensor nodes in an ordered network, each said sensor node comprising at least one sensor configured to sense passing vehicles with all degrees of freedom of rotation alignment, each said sensor node having a programmable power management mode including standby and operations times corresponding to high and low-density traffic behavior, respectively, each said sensor node configured during operations to detect the time and direction of travel of a passing vehicle and broadcast via a communication link a detection message including a node identifier, the detection time and the direction and to receive detection messages from adjacent nodes, each said sensor node operating in a delay mode in which upon passing of a specified time increment from the detection time reported by the adjacent node without detecting the passage of the anticipated vehicle broadcasts an alert delay message including a node identifier, an alert time of vehicle non-arrival and the direction of travel via the communication link; and a control station including a computer configured to receive alert delay messages and, knowing the topology of the ordered network and the geolocation of each said sensor node, to facilitate timely dispatch of an asset to investigate the anomalous behavior of the vehicle.

22. The network of claim 7, wherein said sensor node comprises at least one sensor configured to sense passing vehicles with at least one degree of freedom of rotation alignment and at least one constrained degree of freedom of rotation alignment, said sensor node further comprising means to orient the node to satisfy said at least one constrained degree of freedom.

23. The network of claim 22, wherein said node includes an alignment axis, said means configured to orient the node so that the alignment axis lies approximately perpendicular to a surface on which the node is placed, said node including as plurality of sensors positioned around the axis so that the node is insensitive to rotation about the alignment axis.

24. A network of traffic behavior-monitoring unattended ground sensors, comprising:

a plurality of autonomously-powered sensor nodes in an ordered network, each said sensor node having a programmable power management mode including standby and operations times corresponding to high and low-density traffic behavior, respectively, each said sensor node configured during operations to detect the time and direction of travel of a passing vehicle and broadcast via a communication link a detection message including a node identifier, the detection time and the direction and to receive detection messages from adjacent nodes, each said sensor node operating in a delay mode in which upon passing of a specified time increment of an expected time increment plus a delay time increment from the detection time reported by the adjacent node without detecting the passage of the anticipated vehicle broadcasts an alert delay message including a node identifier, an alert time of vehicle non-arrival and the direction of travel via the communication link; and a control station including a computer configured to receive alert delay messages and, knowing the topology of the ordered network and the geolocation of each said sensor node, to facilitate timely dispatch of an asset to investigate the anomalous behavior of the vehicle.

25. The network of claim 24, wherein said network of sensor nodes has a calibration mode in which the nodes gather statistics on the time increments of vehicles passing adjacent nodes in the network to determine the expected time increments for each said sensor node.

26. The network of claim 25, wherein the delay time increment is one of a fixed multiplier of the expected time increment, a fixed and possibly fractional number of standard deviations beyond the expected time increment, a threshold vehicle stop time or a delay calibrated to a specified nuisance alarm rate.

27. The network of claim 26, wherein the control station broadcasts control messages to the network of sensor nodes, said control messages including the delay time increment.

28. The network of claim 24, wherein the detection message includes a history of actual time increments for the passing vehicle as it travels through the network, said sensor node modifying the expected time increments based on the history to trigger the alert delay message for that passing vehicle.

29. A network of traffic behavior-monitoring unattended ground sensors, comprising:

a plurality of autonomously-powered sensor nodes in an ordered network, each said sensor node having a programmable power management mode including standby and operations times corresponding to high and low-density traffic behavior, respectively, each said sensor node configured during operations to detect the time and direction of travel of a passing vehicle and broadcast via a communication link a detection message including a node identifier, the detection time and the direction and to receive detection messages from adjacent nodes, each said sensor node operating in a delay mode in which upon passing of a specified time increment from the detection time reported by the adjacent node without detecting the passage of the anticipated vehicle broadcasts an alert delay message including a node identifier, an alert time of vehicle non-arrival and the direction of travel via the communication link, wherein the sensor node periodically broadcasts the alert delay message until the node either detects the passing vehicle or times out; and a control station including a computer configured to receive alert delay messages and, knowing the topology of the ordered network and the geolocation of each said sensor node, to facilitate timely dispatch of an asset to investigate the anomalous behavior of the vehicle.

30. A network of traffic behavior-monitoring unattended ground sensors, comprising:

a plurality of autonomously-powered sensor nodes in an ordered network, each said sensor node having a programmable power management mode including standby and operations times corresponding to high and low-density traffic behavior, respectively, each said sensor node configured during operations to detect the time and direction of travel of a passing vehicle and broadcast via a communication link a detection message including a node identifier, the detection time and the direction and to receive detection messages from adjacent nodes, each said sensor node operating in a delay mode in which upon passing of a specified time increment from the detection time reported by the adjacent node without detecting the passage of the anticipated vehicle broadcasts an alert delay message including a node identifier, an alert time of vehicle non-arrival and the direction of travel via the communication link, wherein each said node includes a geolocation receiver for measuring the geolocation of the node, said node sending a message to the control station including its geolocation, wherein after emplacement said node periodically measures its geolocation, if said node detects that it has moved the node broadcasts an alert tamper message; and a control station including a computer configured to receive alert delay messages and, knowing the topology of the ordered network and the geolocation of each said sensor node, to facilitate timely dispatch of an asset to investigate the anomalous behavior of the vehicle.

31. A network of traffic behavior-monitoring unattended ground sensors, comprising:

a plurality of autonomously-powered sensor nodes in an ordered network, each said sensor node having a programmable power management mode including standby and operations times corresponding to high and low-density traffic behavior, respectively, each said sensor node configured during operations to detect the time and direction of travel of a passing vehicle and broadcast via a communication link a detection message including a node identifier, the detection time and the direction and to receive detection messages from adjacent nodes, each said sensor node operating in a delay mode in which upon passing of a specified time increment from the detection time reported by the adjacent node without detecting the passage of the anticipated vehicle broadcasts an alert delay message including a node identifier, an alert time of vehicle non-arrival and the direction of travel via the communication link; and a control station that broadcasts sequential node identifiers to the sensor nodes to define the ordered network, said control station including a computer configured to receive alert delay messages and, knowing the topology of the ordered network and the geolocation of each said sensor node, to facilitate timely dispatch of an asset to investigate the anomalous behavior of the vehicle.

32. A network of traffic behavior-monitoring unattended ground sensors, comprising:

a plurality of autonomously-powered remotely-programmable sensor nodes in an ordered network, each said sensor node having a geolocation receiver for measuring the geolocation of the node, each said node broadcasting its geolocation and operational status and receiving a node-identification number, each said sensor node having a power management mode including standby and operations times corresponding to high and low-density traffic behavior, respectively, each said sensor node configured during operations to detect the time and direction of travel of a passing vehicle and broadcast via a communication link a detection message including a node identifier, the detection time and the direction of vehicle travel and to receive detection messages from adjacent nodes, each said sensor node remotely programmable to operate in (a) an alert detection mode in which the detection messages are broadcast as alert detection messages, (b) a delay mode in which upon passing of an expected time increment plus a delay time increment from the detection time reported by the adjacent node without detecting the passage of the anticipated vehicle said sensor node broadcasts an alert delay message including a node identifier, an alert time of non-arrival and the direction of travel via the communication link and (c) a track mode in which upon broadcast of an alert delay message at least the sensor nodes in the vicinity of that sensor node enable alert detection mode; and a control station including a computer configured to receive the geolocation and operational status of each said sensor node and to broadcast the node-identification numbers, said control station configured to receive alert detection messages and alert delay messages and knowing the topology of the ordered network and the geolocation of each said sensor node to facilitate timely dispatch of an asset to investigate the anomalous behavior of the vehicle.

33. The network of claim 32, wherein the sensor nodes comprise an audio or seismic vibration sensor and a magnetic sensor to detect the passing vehicles.

34. The network of claim 32, wherein said network of sensor nodes has a calibration mode in which the network gathers statistics on the time increments of vehicles passing adjacent nodes in the network to determine the expected time increments for each said sensor node, said delay time increment selected from one of a fixed multiplier of the expected time increment, a fixed and possibly fractional number of standard deviations beyond the expected time increment, a threshold vehicle stop time or to satisfy a specified nuisance alarm rate.

35. The network of claim 32, wherein the detection message includes a history of actual time increments for the passing vehicle, said sensor node modifying the expected time increments based on the history to trigger the alert delay message for that passing vehicle.

36. The network of claim 35, wherein the control station broadcasts control messages to the network of sensor nodes, said control messages specifying the delay time increment.

37. A network of traffic behavior-monitoring unattended ground sensors, comprising:

a plurality of autonomously-powered remotely-programmable sensor nodes in an ordered network, each said sensor node configured to detect the time and direction of travel of a passing vehicle and broadcast via a communication link a detection message including a node identifier, the detection time and the direction of vehicle travel and to receive detection messages from adjacent nodes, each said sensor node remotely programmable to operate in (a) an alert detection mode in which the detection messages are broadcast as alert detection messages, (b) a delay mode in which upon passing of a specified time increment, from the detection time reported by the adjacent node without detecting the passage of the anticipated vehicle said sensor node broadcasts an alert delay message including a node identifier, an alert time of non-arrival and the direction of travel via the communication link and (c) a track mode in which upon broadcast of an alert delay message at least the sensor nodes in the vicinity of that sensor node enable alert detection mode.

* * * * *